US008303067B2

(12) United States Patent
Kitaoka

(10) Patent No.: US 8,303,067 B2
(45) Date of Patent: Nov. 6, 2012

(54) IMAGE FORMING APPARATUS

(75) Inventor: Naoko Kitaoka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 157 days.

(21) Appl. No.: 12/881,474

(22) Filed: Sep. 14, 2010

(65) Prior Publication Data

US 2011/0063351 A1 Mar. 17, 2011

(30) Foreign Application Priority Data

Sep. 15, 2009 (JP) ..... 2009-212904

(51) Int. Cl.
*B41J 29/38* (2006.01)
*B41J 2/045* (2006.01)

(52) U.S. Cl. ..... 347/11; 347/68

(58) Field of Classification Search ..... 347/10, 347/11, 68–72
See application file for complete search history.

(56) References Cited

U.S. PATENT DOCUMENTS 6,290,315 B1 * 9/2001 Sayama ..... 347/10
6,431,675 B1 * 8/2002 Chang ..... 347/10
6,450,603 B1 9/2002 Chang
2002/0033852 A1 3/2002 Chang
2003/0117454 A1 6/2003 Junhua et al.
2007/0008356 A1 1/2007 Katoh
2008/0117262 A1 5/2008 Mori et al.

FOREIGN PATENT DOCUMENTS

JP 11-277736 10/1999
JP 2002-154207 5/2002
JP 2003-118107 4/2003
JP 3671955 4/2005
JP 3912270 2/2007
JP 4032338 11/2007
JP 4251912 1/2009

* cited by examiner

*Primary Examiner* — Geoffrey Mruk
(74) *Attorney, Agent, or Firm* — Cooper & Dunham LLP

(57) ABSTRACT

An image forming apparatus includes a recording head having nozzles ejecting liquid droplets, a liquid chamber in communication with the nozzles, a pressure generator unit generating pressure inside the liquid chamber, and a head drive control unit to generate a drive waveform having plural drive pulses arranged in time series, each of the drive pulses having waveform components, to form an ejecting pulse for ejecting the liquid droplets by selecting one or more of the plural drive pulses based on a corresponding one of liquid droplet sizes and supply the formed ejecting pulse to the pressure generator unit. In the image forming apparatus, when the ejecting pulse is formed by selecting one or more of the plural drive pulses, shapes of the waveform components of the selected plural drive pulses are partially changed based on the corresponding one of the liquid droplet sizes.

8 Claims, 17 Drawing Sheets

IMAGE FORMING APPARATUS

BACKGROUND OF THE INVENTION

1. Field of the Invention

The invention generally relates to an image forming apparatus having a recording head for ejecting ink droplets and more specifically to a drive control of the recording head of the image forming apparatus.

2. Description of the Related Art

An inkjet recording apparatus is generally known as an inkjet image forming apparatus having a liquid ejecting head (inkjet head or recording head) for ejecting ink droplets. Examples of such an inkjet image forming apparatus having the inkjet head include image forming apparatuses having a function of a printer, a facsimile machine, or a plotter, or a combination of these functions. The inkjet image forming apparatus having the inkjet head is configured to eject ink droplets from the inkjet head onto a transferred sheet (recording medium) to form an image. The formation of the image also includes recording, printing, and imaging. There are two types of the inkjet image forming apparatus including 1) a serial type image forming apparatus in which the inkjet head ejects ink droplets onto the sheet to form an image while traveling in a main-scanning direction; and 2) a line type image forming apparatus in which the inkjet head ejects ink droplets onto the sheet to form an image without traveling. Note that the sheet is not limited to paper but includes any media including an OHP insofar as ink droplets or other liquid can be adhered to the media. Such media are also referred to as a subject recording medium or a recording medium, a recording sheet, and a recording form.

Note that in this application, the "inkjet image forming apparatus" indicates an image forming apparatus that forms an image onto media such as paper, string, fiber, fabric, leather, metal, plastic, glass, wood, and ceramics by ejecting liquid onto such media. Note also that "forming an image" or "image formation" not only indicates providing an image having some kind of meanings onto the media such as characters and symbols, but also indicates an image without having any meanings such as patterns (i.e., by simply ejecting ink droplets onto the media). Further, "ink" is not limited to those generally called "ink", but includes the name "ink" used as a generic name for liquid capable of forming an image such as recording liquid, fixing liquid, and "liquid". The ink in this application also indicates DNA specimens, resist, patterning material, resin, and the like. Moreover, the "image" is not limited to the image applied to a two-dimensional object but includes the image applied to a three-dimensional object and the image formed of a molded object.

As described above, there are two types of the inkjet image forming apparatus including 1) the serial type image forming apparatus in which the inkjet head is attached to a carriage so that the inkjet head travels in the main-scanning direction perpendicular to a direction toward which the sheet is transferred while ejecting ink droplets onto the sheet to form an image; and 2) the line type image forming apparatus having a line type head with plural nozzle arrays from which ink droplets are ejected to an approximately entire length of a recording region of the sheet to form an image.

In such image forming apparatuses, plural drive pulses (ejecting pulses) for ejecting ink droplets within one printing cycle are generated in time series to form common drive waveforms. For example, when relatively large dots are formed, two or more drive pulses are selected so that the inkjet head ejects plural ink droplets based on the selected drive pulses. Accordingly, the plural ink droplets are, while being ejected, combined to form a dot or a droplet having various sizes. Or, non-ejecting pulses based on which the head is driven without ejecting ink droplets are also generated and the generated non-ejecting pulses are combined into the common drive waveforms. When the non-ejecting pulses are selected, the inkjet head is slightly driven or slightly oscillates.

For example, Japanese Patent No. 3671955 (also referred to as Patent Document 1) discloses an inkjet apparatus that includes a first drive signal generator unit capable of generating a first drive signal having at least two first drive pulses composed of plural waveform components within one ejecting cycle, and a second drive signal generator unit capable of generating a second drive signal having at least one second drive pulse composed of plural waveform components within one ejecting cycle, where part of the first pulse and part of the second pulse are selected to form a non-ejecting pulse.

Japanese Patent Application Publication No. 2003-118107 (also referred to as Patent Document 2) and Japanese Patent Application Publication No. 2002-154207 (also referred to as Patent Document 3) disclose an inkjet apparatus that includes a drive signal generator unit generating a drive signal for generating a micro-vibration pulse applied to a pressure generator unit to minutely oscillate plural types of ejecting pulses and a liquid meniscus, a pulse generator unit generating the minute oscillation pulses and the ejecting pulses by selecting parts of the drive pulses forming the drive signal, where a start end and a terminal end of the drive signal are at a common potential, at least one of a plurality of kinds of ejecting pulses includes a waveform component having a terminal end at a potential different from the common potential, and adjusting waveform components for connecting the terminal end preset at the potential different from the common potential to a point preset at the common potential, and waveform components which constitute parts of minute oscillation pulses are used as at least parts of the adjusting waveform components.

Japanese Patent No. 4032338 (also referred to as Patent Document 4) discloses an inkjet apparatus having a pressure generator unit capable of changing ink pressure in a chamber by expanding or contracting the chamber based on drive pulses such that ink droplets are ejected from nozzle openings based on the pressure change in the chamber. The inkjet apparatus includes a drive signal generator unit generating a first drive signal and a drive pulse generator unit generating a drive pulse based on the drive signal, where the drive pulse generator unit generates a first drive pulse including an expanding waveform component to expand the chamber and hold the expanded chamber, a first filling waveform component to further expand the chamber expanded by the expanding waveform component, and a first ejecting waveform component to contract the chamber expanded by the first filling waveform component, and the drive pulse generator unit also generates a second drive pulse including a contracting waveform component to contract the chamber and hold the contracted chamber, a second filling waveform component to expands the contracted chamber held by the contracting waveform component to supply ink in the chamber, and a second ejecting waveform component to contract the chamber expanded by the second filling waveform component, thereby, generating different gray scale pulses based on the first and second drive pulses.

Japanese Patent No. 4251912 (also referred to as Patent Document 5) discloses an inkjet apparatus having a head that is driven by selecting a desired one of driving waveforms having at least an ejecting pulse for ejecting liquid droplets, a first dummy pulse and a second dummy pulse having voltages smaller than that of the ejecting pulse before and after the liquid droplet ejection, thereby generating a non-ejecting pulse generating energy that generates a pulse width longer than the ejecting pulse from part of the first dummy pulse and part of the second dummy pulse without allowing a nozzle to eject liquid droplets.

When plural ink droplets ejected from the head are combined to form plural dots of different sizes, ink droplets having different sizes (i.e., amounts of droplets) to be ejected are determined based on pulse shapes (an element forming a pulse is called a "waveform component") and a driving timing (i.e., a timing to drive). If an ejecting pulse capable of ejecting ink droplets of different sizes (i.e., a pulse for driving a pressure generator unit to eject ink droplets) is generated as a designated pulse and the generated ejecting pulse is embedded in a common drive waveform, the entire drive waveform is elongated. As a result, the drive frequencies are lowered and the printing speed is decreased.

In the inkjet apparatus disclosed by Patent Document 1 that is configured to utilize two drive signals (i.e., drive waveform in the present embodiments), the configuration of the two drive signals to generate and/or select drive waveforms may become complicated. In the inkjet apparatus disclosed by Patent Documents 2 and 3 that is configured to utilize part of the adjusting waveform components embedded in the ejecting pulse for part of the minute oscillation pulse, the ejecting pulse is designated and has a longer drive waveform, which makes it difficult to increase the printing speed. Further, the inkjet apparatus disclosed by Patent Document 4 is configured to generate pulses having different tones based on the first and second drive pulses. However, the inkjet apparatus is not configured to generate different pulse shapes for corresponding droplet sizes, though utilizing part of the drive pulse. Accordingly, the entire drive waveform is still elongated. As a result, it is difficult to increase the printing speed. Moreover, in the inkjet apparatus disclosed by Patent Document 5 that is configured to form the minute drive pulse, the ejecting pulse is designated, and has a longer entire drive waveform. As a result, it is difficult to increase the printing speed.

SUMMARY OF THE INVENTION

Accordingly, embodiments of the present invention may provide a novel and useful inkjet apparatus capable of reducing an entire length of a drive waveform in one printing cycle (also referred to as one driving cycle) to increase the printing speed and increasing reliability of ink droplet ejection by forming ejecting pulses of waveform components for corresponding droplet sizes solving one or more of the problems discussed above.

In one embodiment, there is provided an image forming apparatus that includes a recording head having nozzles configured to eject liquid droplets, a liquid chamber in communication with the nozzles, and a pressure generator unit configured to generate pressure inside the liquid chamber to cause the nozzles to eject the liquid droplets; and a head drive control unit configured to generate a drive waveform having plural drive pulses arranged in time series, each of the drive pulses having waveform components, to format least one ejecting pulse for ejecting the liquid droplets by selecting one or more of the plural drive pulses of the drive waveform based on a corresponding one of liquid droplet sizes, and supply the at least one ejecting pulse based on the corresponding one of the liquid droplet sizes to the pressure generator unit. In the image forming apparatus, when at least one ejecting pulse for ejecting the liquid droplets is formed by selecting one or more of the plural drive pulses, shapes of the waveform components of the selected plural drive pulses are partially changed based on the corresponding one of the liquid droplet sizes.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 1:
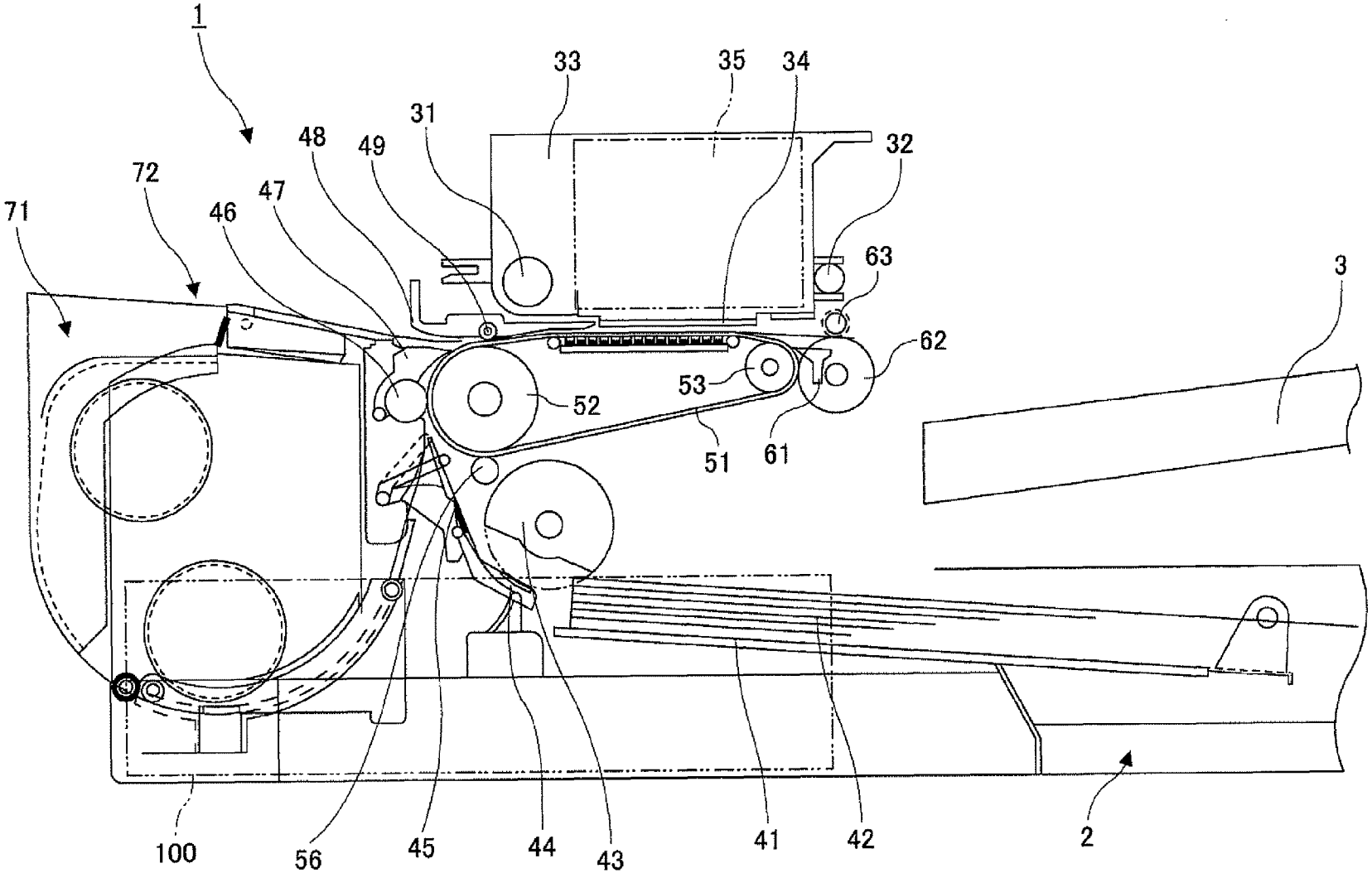
FIG. 1 is a side view of an overall configuration diagram illustrating a mechanical unit of an image forming apparatus according to embodiments of the invention.
Figure 2:
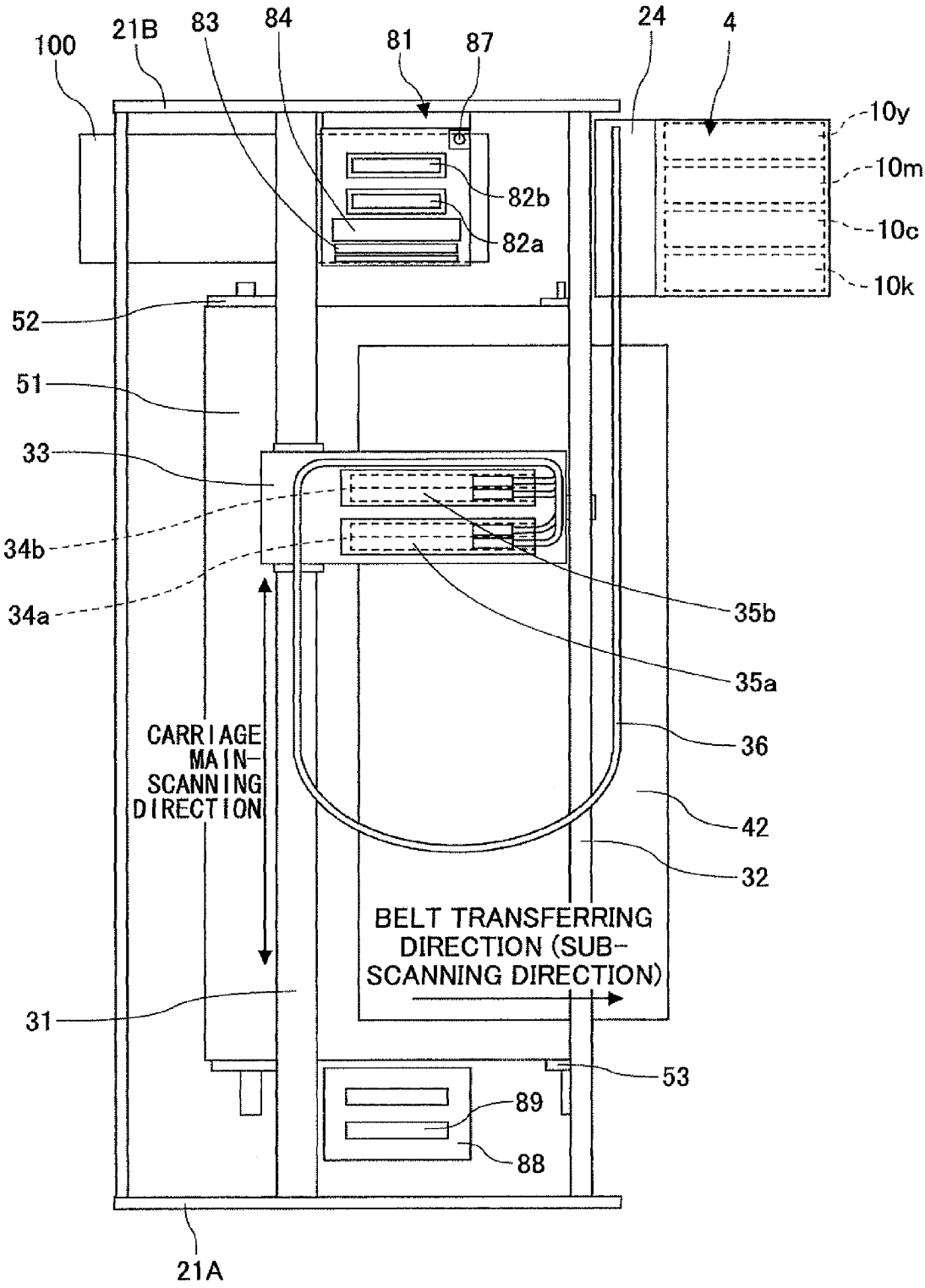
FIG. 2 is a plan view illustrating the mechanical unit of the image forming apparatus.

Preferred embodiments are described below with reference to the accompanying drawings. Initially, an image forming apparatus according to the preferred embodiments is described with reference to FIGS. 1 and 2. Note that FIG. 1 is a side view of the image forming apparatus illustrating its entire configuration, and FIG. 2 is a plan view of the image forming apparatus illustrating its major components.

The image forming apparatus according to the preferred embodiments is a serial inkjet recording apparatus. The recording apparatus (image forming apparatus) includes side plates 21A and 21B located one at each side of a main body 1, a guide member composed of a driving guide rod 31 and a driven guide rod 32 laterally connected to the side plates 21A and 21B to slidably support a carriage 33 in a carriage main-scanning direction, and a not-shown main-scanning motor to drive the carriage 33 to scan in the carriage main-scanning direction (indicated by a left-right arrow) via a timing belt as illustrated in FIG. 2.

The carriage 33 includes a recording head 34 composed of two recording heads 34*a* and 34*b*. The recording heads 34*a* and 34*b* include nozzle arrays composed of plural nozzles arranged in a sub-scanning direction perpendicular to the main scanning direction, and their respective ink droplet directions are downwardly directed for ejecting yellow (Y) ink, cyan (C) ink, magenta (M) ink, and black (K) ink.

The recording heads 34*a* and 34*b* each have two nozzle arrays. The recording head 34*a* includes a first nozzle array to eject black (K) ink droplets and a second nozzle array to eject cyan (C) ink droplets, whereas the recording head 34*b* includes a first nozzle array to eject magenta (M) ink droplets and a second nozzle array to eject yellow (Y) ink droplets. Alternatively, the recording head 34 may include a nozzle face having plural nozzle arrays of respective colors.

The carriage 33 includes a sub tank 35 composed of sub tanks 35*a* and 35*b* as a second ink supplier to supply respective colors of ink to the corresponding nozzle arrays of the recording heads 34*a* and 34*b* (or recording head 34). The sub tank 35 having the sub tanks 35*a* and 35*b* is supplied with respective colors of recording liquid via supply tubes 36 for corresponding colors by a supply pump unit 24 from ink cartridges (main tanks) of respective colors 10*y*, 10*m*, 10*c*, and 10*k* that are detachably attached to a cartridge application unit 4.

The recording apparatus further includes a semicircular feeding roller 43 and a separation pad 44 made of a material having a high friction coefficient and directed to face the feeding roller 43. The feeding roll 43 and the separation pad 44 are used as a sheet-feeding unit for feeding sheets 42 accumulated on a sheet accumulating unit (platen) 41 of a feed tray 2. The sheet-feeding unit composed of the feeding roller 43 and the separation pad 44 is configured to feed one sheet 42 at a time from the sheet accumulating unit 41, and the separation pad 44 is biased toward the feeding roller 43 side.

The recording apparatus further includes a guide member 45 for guiding the sheet, a counter roller 46, a transfer guide member 47, an edge-pressing roll 49, and a presser member 48 in order to transfer the sheet 42 fed from the sheet-feeding unit to a lower side of the recording head 34. The recording apparatus also includes a transfer belt 51 to electrostatically attract the sheet 42 to transfer the sheet 42 at a position facing the recording head 34.

The transfer belt 51 is looped over a transfer roller 52 and a tension roller 53 so as to rotationally travel in a belt transferring direction (sub-scanning direction). The recording apparatus further includes a charging roller 56 to charge a surface of the transfer belt 51. The charging roller 56 is configured to be brought into contact with the surface layer of the transfer belt 51 and be rotationally driven by the rotation of the transfer belt 51. The transfer belt 51 is caused to rotationally travel in the belt transferring direction illustrated in FIG. 2 by the transfer roller 52 that is rotationally driven by a not-shown sub-scanning motor via the timing belt.

The recording apparatus further includes a sheet-discharging unit including a separation claw 61 for separating the sheets from the transfer belt 51, a sheet-discharge roller 62, a spur (sheet-discharge roller) 63, and a sheet-discharge tray 3 located at a lower side of the sheet-discharge roller 62.

The recording apparatus also includes a duplex printing unit 71 detachably attached at the back of the main body 1. The duplex printing unit 71 captures the sheet 42 rotationally transferred in a reverse direction of the transfer belt 51, reverses the sheet 42, and then feeds the reversed sheet 42 between the counter roller 46 and the transfer belt 51. The recording apparatus also includes a manual bypass tray 72 on top of the duplex printing unit 71.

The recording apparatus further includes a retaining-recovery mechanism 81 for retaining and recovering the nozzle states of the recording head 34 in a non-printing region at one side of the carriage 33 in the carriage main-scanning direction. The retaining-recovery mechanism 81 includes cap members (hereinafter called "caps 82*a*, 82*b*" or simply called "caps 82") 82*a* and 82*b* for capping the respective nozzle faces of the recording head 34, a wiper member (wiper blade) 83 for wiping the nozzle faces, a non-recording liquid ejection receiver 84 for receiving non-recording liquid when the recording liquid is thickened and thus discharged, and a carriage lock 87 for locking the carriage 33. The recording apparatus also includes a replaceable waste tank 100 attached at a lower side of the retaining-recovery mechanism 81 of the recording head 34 to store waste liquid discharged by retaining-recovery operations.

The recording apparatus further includes a non-recording liquid ejection receiver 88 in a non-printing region at the other side of the carriage 33 in the carriage main-scanning direction so as to receive the non-recording liquid when the recording liquid is thickened and thus discharged. The non-recording liquid ejection receiver 88 includes an opening 89 along the nozzle array direction of the recording head 34.

In the image forming apparatus (recording apparatus) having the above configuration, the top sheet 42 is separated from those others in the feed tray 2, the sheet 42 is approximately vertically arranged to be guided by the guide member 45, the sheet 42 is sandwiched between the transfer belt 51 and the counter roller 46 to be transferred, the edge of the sheet 42 is guided by the transfer guide member 47, and pressed against the transfer belt 51 by the edge-pressing roll 49, and then the transfer direction of the sheet 42 is changed by approximately 90 degrees.

In this process, voltages are applied to the charging roller 56 to alternately generate plus output and minus output, so that the transfer belt 51 is charged with alternating charge voltage patterns. If the sheet 42 is fed onto the charged transfer belt 51, the sheet 42 is attracted onto the transfer belt 51 and then transferred in the sub-scanning direction by the rotational travelling of the transfer belt 51.

The recording head 34 is driven while moving the carriage 33 based on the image signals so as to eject ink droplets onto the stationary sheet 42, thereby recording one line of the ink droplets. The sheet 42 is then transferred by a predetermined amount, and the next line of droplets is recording on the sheet 42. The recording operation is terminated when a recording end signal is received or when a signal indicates that a rear end of the sheet 42 has reached the recording region, and the sheet 42 is then discharged onto the sheet-discharge tray 3.

When the nozzles of the recording head 34 undergo retaining or recovery, the carriage 33 is moved to a home position facing the retaining-recovery mechanism 81, where the retaining-recovery operations such as a non-recording liquid ejection operation are carried out including capping of the nozzles with the caps 82, and suctioning the non-recording liquid from the nozzles. As a result, ink is stably ejected onto the sheet to form an image.

Figure 3:
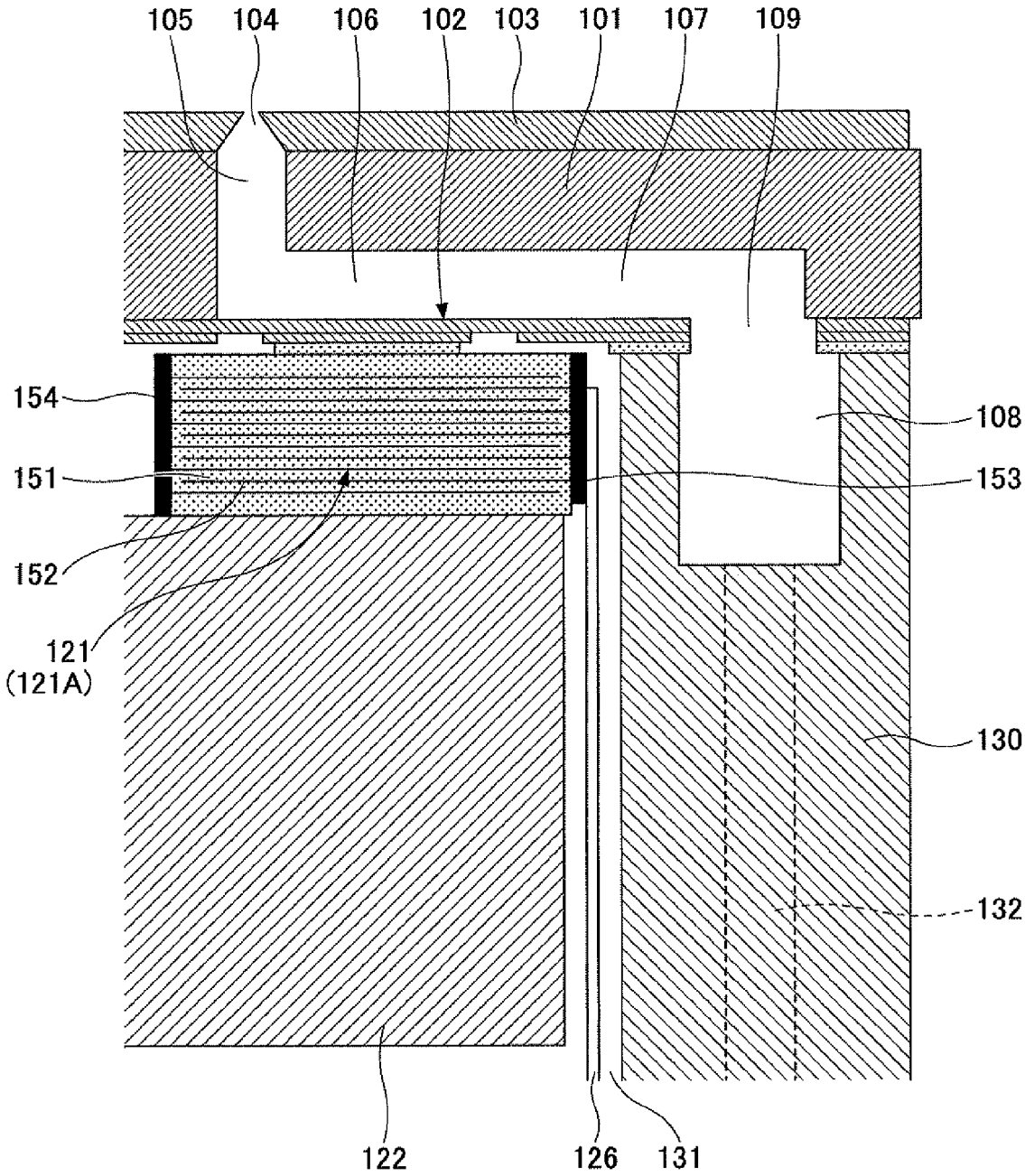
FIG. 3 is a sectional view illustrating one example of a liquid-droplet jet head constituting a recording head of the image forming apparatus sectioned along a lengthwise direction of a chamber.
Figure 4:
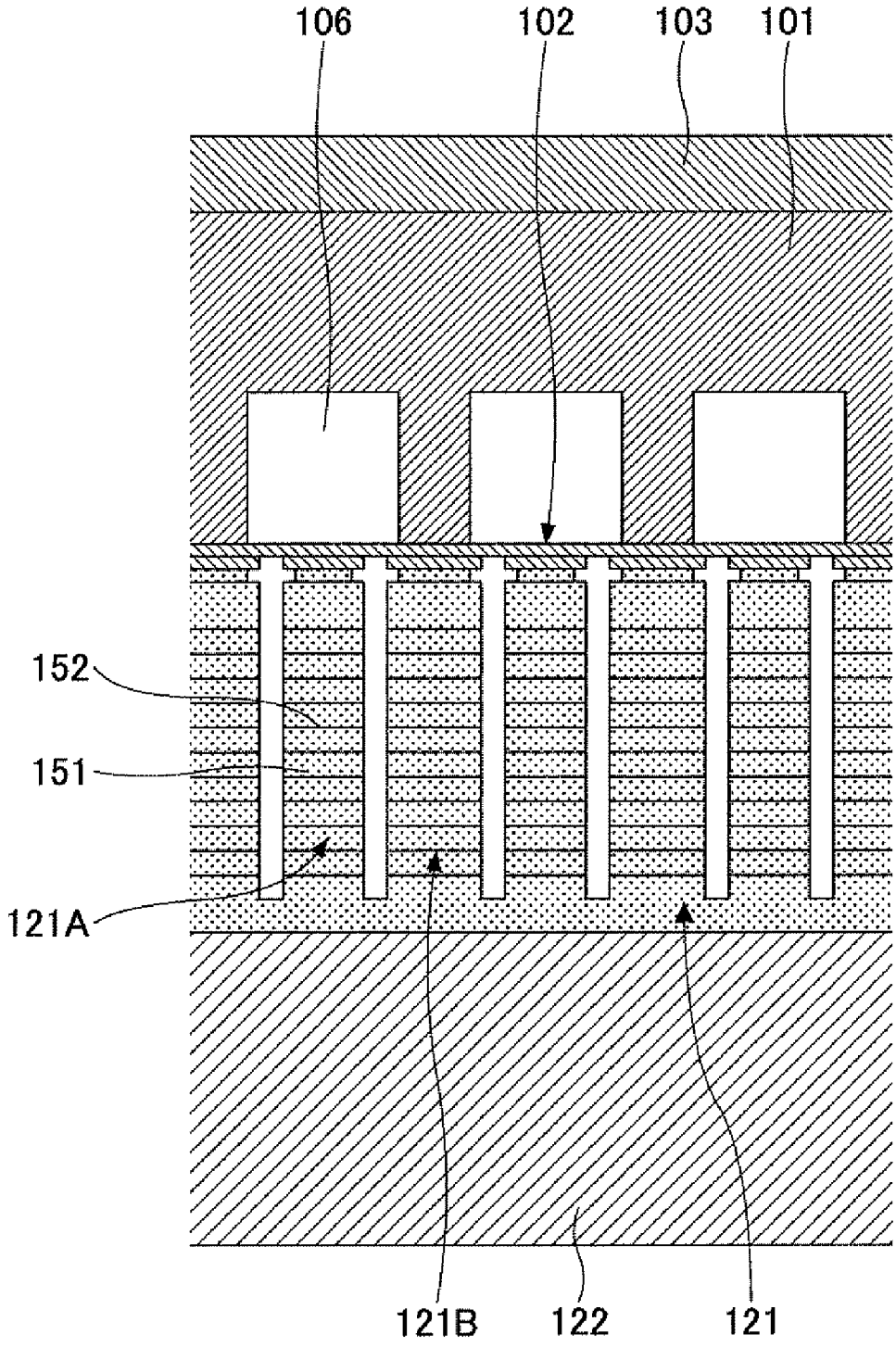
FIG. 4 is a sectional view illustrating one example of the liquid-droplet jet head constituting the recording head of the image forming apparatus sectioned along a crosswise direction of the chamber.

Next, an example of a liquid ejecting head (inkjet head) constituting the recording head 34 is described with reference to FIGS. 3 and 4. Note that FIG. 3 is a sectional view sectioned along a lengthwise direction of a pressurizing liquid chamber 106 of the liquid-droplet jet head (inkjet head) constituting the recording head 34 of the image forming apparatus, and FIG. 4 is a sectional view sectioned along a crosswise direction of the pressurizing liquid chamber 106.

The inkjet head includes a passage plate 101, an oscillation plate 102 connected to a lower surface of the passage plate 101, and a nozzle plate 103 connected to an upper surface of the passage plate 101. The passage plate 101, the oscillation plate 102, and the nozzle plate 103 are arranged in a layer to form a nozzle communication path 105 in communication with the nozzles 104 ejecting liquid droplets (ink droplets), the pressurizing liquid chamber 106 used as a pressure generating chamber, and an ink supply port 109 in communication with a common liquid chamber 108 for supplying ink to the pressurizing liquid chamber 106 via a fluid resistor unit (fluid supply path) 107.

The inkjet head further includes two stacked piezoelectric members (i.e., electromechanical transducer) 121 used in the pressure generator unit (actuator unit) for deforming the oscillation plate 102 to pressurize the ink in the pressurizing liquid chamber 106. The piezoelectric members 121 form piezoelectric element columns 121A and 121B, which are made by forming slits in the piezoelectric members 121. In this example, the piezoelectric element column 121A is used as a driving piezoelectric element column that applies drive waveforms, and the piezoelectric element column 121A is used as a non-driving piezoelectric element column that does not apply the drive waveforms. The piezoelectric element columns 121A of the piezoelectric members 121 include a Flexible Printed Circuit (FPC) cable 126 having a not-shown drive circuit (a drive IC).

Circumference portions of the oscillation plate 102 are connected to a frame member 130. The frame member 130 includes a through hole portions 131 for accommodating an actuator unit composed of the piezoelectric members 121 and a base substrate 122, a recess portion of the common liquid chamber 108, and an ink supply hole 132 used as a liquid supply port for supplying ink from outside to the common liquid chamber 108.

Note that the passage plate 101 has the nozzle communication path 105 and a recess portion, a hole, and the like, which are obtained by anisotropically etching a single crystal silicon substrate having a crystal face orientation (110) with an alkaline etchant such as a potassium hydroxide (KOH) aqueous solution. However, the passage plate 101 is not limited to being made of the single crystal silicon substrate. The passage plate 101 may be made of other materials such as a stainless steel substrate or photosensitive resin.

The oscillation plate 102 is made of a metallic nickel plate and is fabricated, for example, by electroforming; however, the oscillation plate 102 maybe made of other metallic plates or a connected member of metal and resin plates. The piezoelectric element columns 121A and 121B of the piezoelectric members 121 are bonded to the oscillation plate 102 with adhesive, which are further bonded to the frame member 130 with adhesive.

The nozzle plate 103 includes the nozzles 104 having a diameter of 10 to 30 μm corresponding to the respective liquid chambers 106, and the nozzle plate 103 is bonded to the passage plate 101 with adhesive. The nozzle plate 103 is obtained by forming a water-repellent layer on a surface of a nozzle forming member made of metal via predetermined layers.

The piezoelectric member 121 is the stacked piezoelectric member (PZT) obtained by alternately stacking a piezoelectric materials 151 and internal electrodes 152. An individual electrode 153 and a common electrode 154 are connected to each of the internal electrodes 152 alternately pulled out to different end faces of the piezoelectric member 121. Note that in this embodiment, the inkjet head is configured such that the ink in the pressurizing liquid chamber 106 is pressurized using a displacement in a not-shown d33 direction as a piezoelectric direction of the piezoelectric member. However, the inkjet head may be configured such that the ink in the pressurizing liquid chamber 106 is pressurized using a displacement in a not-shown d31 direction as a piezoelectric direction of the piezoelectric member.

In the inkjet head having the above configuration, the potential applied to the piezoelectric member 121 is lowered from a reference potential Ve to cause the driving piezoelectric member column 121A to contract, which lowers the oscillation plate 102 and expands the volume of the pressurizing liquid chamber 106. As a result, ink flows into the pressurizing liquid chamber 106. Thereafter, the potential applied to the piezoelectric element column 121A is raised to cause the piezoelectric element column 121A to extend in a stacked direction, which deforms the oscillation plate 102 toward the nozzle 104 direction. The deformation of the oscillation plate 102 toward the nozzle 104 causes the volume of the pressurizing liquid chamber 106 to contract so that the ink in the pressurizing liquid chamber 106 is pressurized to thereby eject ink droplets from the nozzles 104.

When the voltage applied to the driving piezoelectric member column 121A returns to the reference potential Ve, the oscillation plate 102 returns to an initial position, which causes the pressurizing liquid chamber 106 to expand. Accordingly, a negative pressure is generated in the pressurizing liquid chamber 106. As a result, the ink is supplied into the pressurizing liquid chamber 106 from the common liquid chamber 108. When the oscillations of meniscus faces in the nozzles 104 are damped and stabilized, the inkjet head is moved for a next operation.

Note that the method for driving the inkjet head is not limited to the above example, but the inkjet head may be driven by applying the drive waveform in different ways to one of the piezoelectric element column 121A and the piezoelectric element column 121B for expansion and contraction of the pressurizing liquid chamber 106.

Figure 5:
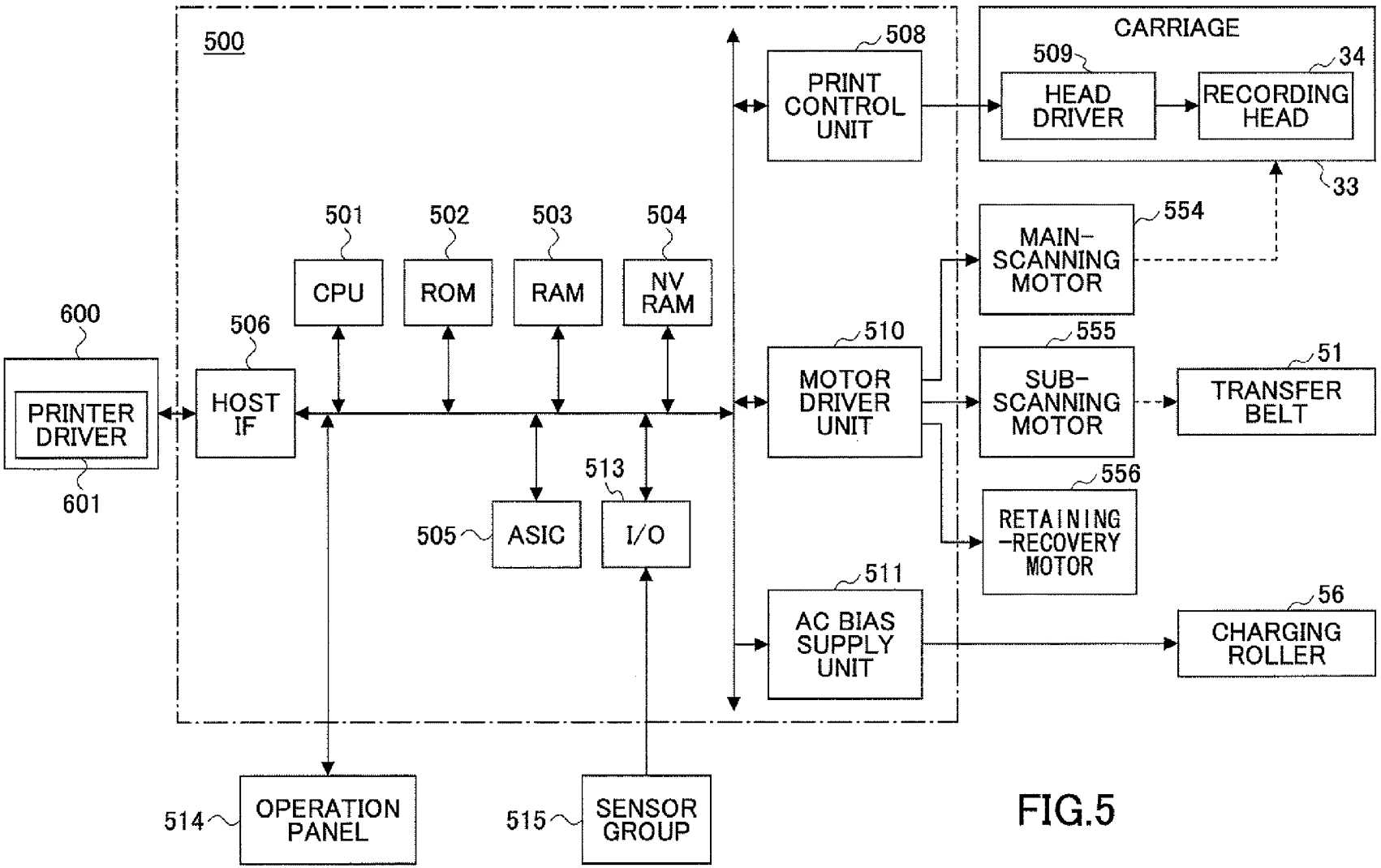
FIG. 5 is a schematic block diagram illustrating a control unit of the image forming apparatus.

Next, an outline of a control unit 500 of the image forming apparatus (recording apparatus) is described with reference to FIG. 5. Note that FIG. 5 is a block diagram illustrating the control unit 500 of the image forming apparatus. The control unit 500 includes a CPU 501 configured to control the entire image forming apparatus and a non-recording liquid ejection operation, a ROM 502 configured to store computer programs to be executed by the CPU 501 and other fixed data, a RAM 503 configured to temporarily store data such as image data, a rewritable non-volatile memory 504 configured to store data regardless of the power supply of the image forming apparatus being turned on or off, and an ASIC (application-specific integrated circuit) 505 configured to process various signals for processing image data, and input and output signals for image processing such as sorting and for controlling the entire image forming apparatus.

The control unit 500 further includes a print control unit 508 including a data transfer unit and a drive signal generator unit for drive controlling the recording head 34, a head driver (driver IC) 509 for driving the recording head 34 provided at the carriage 33 side, a motor drive unit 510 for driving a main-scanning motor 554 to move the carriage 33 to scan, a sub-scanning motor 555 to rotationally move the transfer belt 51, a retaining-recovery motor 556 to move the caps 82 of retaining-recovery mechanism 81 and wiper member 83, and an AC bias supply unit 511 to supply an AC bias to the charging roller 56.

Further, the control unit 500 is connected to an operations panel 514 for inputting and displaying desired information for the image forming apparatus.

The control unit 500 further includes a host IF 506 to communicate with a host side 600 for receiving and sending data and signals, such that the host IF 506 receives the data and signals via a cable or the network from the host side 600 including an information processing apparatus such as a personal computer, an image reading apparatus such as an image scanner, and an imaging apparatus such as a digital camera.

The CPU 501 of the control unit 500 retrieves printing data from a receive buffer in the host IF 506 to analyze the retrieved printing data, causes the ASIC 505 to carry out desired processing such as image processing or sorting data, and transfers the processed data from the print control unit 508 to the head driver 509. Note that dot pattern data for outputting images are generated by a printer driver 601 located at the host side 600.

The print control unit 508 serially transfers the above image data while outputting transfer clocks, latch signals, and control signals required for transferring the above image data to the head driver 509. The print control unit 508 further includes a drive signal generator unit composed of a D/A converter for D/A converting pattern data of drive pulses stored in the ROM 502, a voltage amplifier, and a current amplifier to output a drive signal composed of one or more drive pulses to the head driver 509.

The head driver 509 generates ejecting pulses by selecting the drive pulses forming a drive waveform supplied from the print control unit 508 based on the image data corresponding to one line of the image data serially input to the recording head 34. The head driver 509 then applies the generated ejecting pulses to the piezoelectric members 121 used as a pressure generator unit to generate energy for ejecting liquid droplets, thereby driving the recording head 34. In this process, different sizes of dots (liquid droplets) such as large, medium, small sized droplets may be formed by selecting a part of or an entire part of the corresponding drive pulses constituting the drive signal or part of or all the waveform components constituting the corresponding drive pluses.

An input-output (I/O) unit 513 acquires information from a sensor group 515 having various sensors attached to the image forming apparatus, selects desired information for controlling the printer to apply the acquired information for controlling the print control unit 508, the motor drive unit 510, and the AC bias supply unit 511. The sensor group 515 includes optical sensors to detect positions of the sheet, a thermistor to monitor the temperature within the apparatus, sensors to monitor the voltage of the charging belt, and an interlock switch to detect open or close state of a cover. The I/O unit 513 is configured to process various kinds of sensor information.

Figure 6:
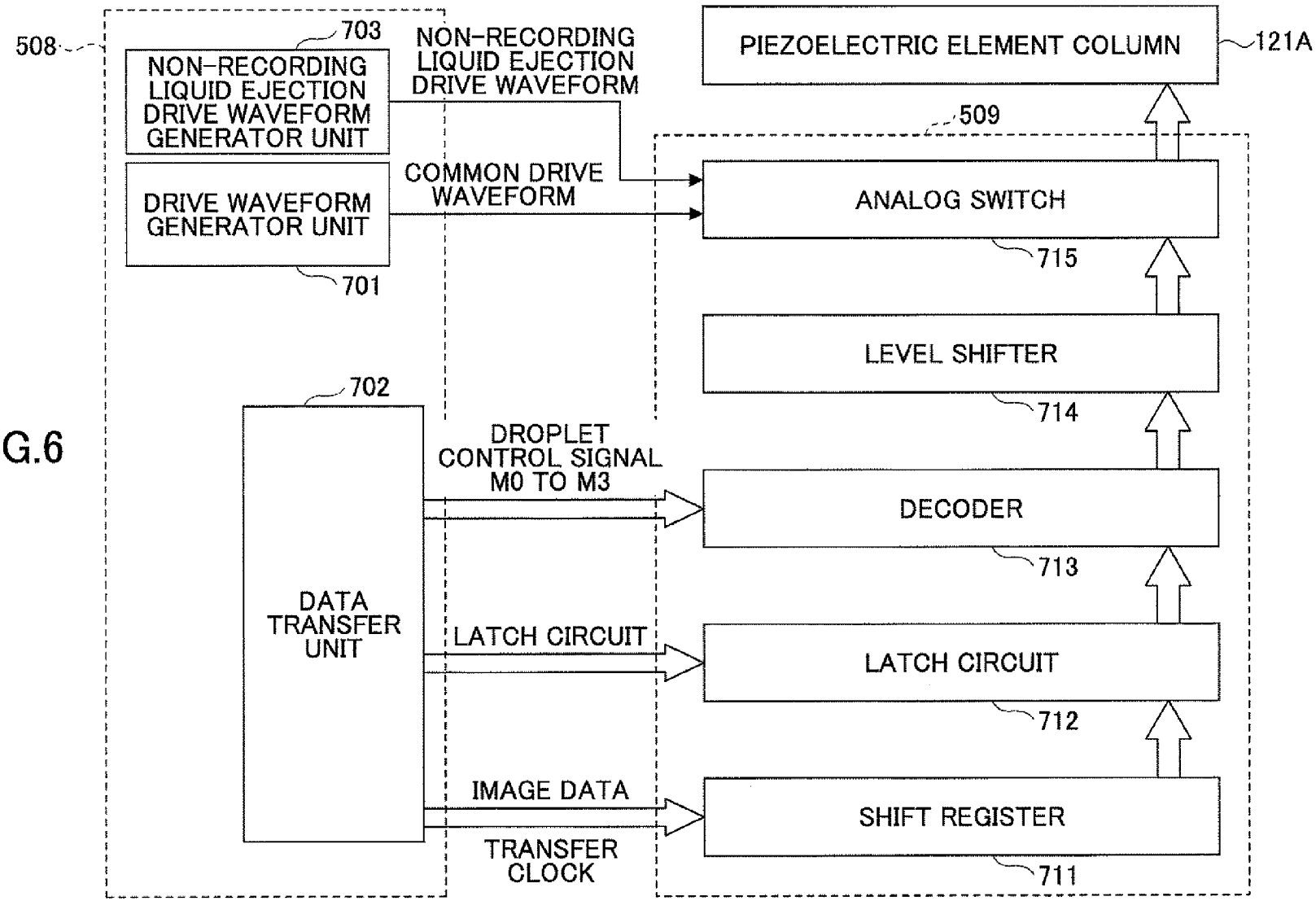
FIG. 6 is a block diagram illustrating respective examples of a print control unit and a head driver of the control unit of the image forming apparatus.

Next, examples of the print control unit 508 and the head driver 509 are described with reference to FIG. 6. The print control unit 508 includes a drive waveform generator unit 701 configured to generate a drive waveform (common drive waveform) having plural drive pulses (of drive signal) within one printing cycle, a data transfer unit 702 configured to generate 2-bit image data (grayscale signal 0, 1) corresponding to a printed image, clock signals, latch signals (LAT), droplet control signals M0 through M3, and a non-recording liquid ejection drive waveform generator unit 703 configured to generate a drive waveform for ejecting non-recording liquid.

Note that the droplet control signal is a 2-bit signal for instructing switching of the analog switch 715 used as a later-described switching unit of the head driver 509. The droplet control signal switches on or switches to a high (H) level for selecting the drive pulses or the drive waveform components, and switches off or switches to a low (L) level for not selecting the drive pulses or the drive waveform components, based on the printing cycle of the common drive waveform.

The head driver 509 includes a shift register 711 configured to input transfer clocks (shift clocks) transferred from a data transfer unit 702 and serial image data (grayscale data: 2 bits/1 channel (1 nozzle)), a latch circuit 712 configured to latch various registration values from the shift register 711 with latch signals, a decoder 713 configured to decode the grayscale data and the droplet control signals M0 through M3 and output the decoded results, a level shifter 714 configured to carry out level conversion on a logic-level voltage signal of the decoder 713 to an operable analog-level voltage signal, and an analog switch 715 configured to acquire the operable analog-level voltage signal of the decoder 713 via the level shifter 714 to switch on or off (open or close).

The analog switch 715 is connected to not-shown selection electrodes (separate electrodes) of the piezoelectric members 121 (121A in FIG. 6) so that the common drive waveforms are supplied to the analog switch 715 via the drive waveform generator unit 701. Accordingly, when the analog switch 715 is switched on in response to the decoded results of the serially transferred image data (grayscale data) and the decoded results of the droplet control signals M0 through M3 decoded by the decoder 713, desired drive pulses and waveform components constituting the common drive waveform are applied to the piezoelectric members 121 (121A in FIG. 6).

When carrying out the non-recording liquid ejection operation, the non-recording liquid ejection drive waveform generator unit 703 generates a non-recording liquid ejection waveform and supplies the generated non-recording liquid ejection waveform to the analog switch 715. Note that the common drive waveform and the non-recording liquid ejection drive waveform are selectively generated by the corresponding one of the drive waveform generator unit 701 and the non-recording liquid ejection drive waveform generator unit 703; or the common drive waveform and the non-recording liquid ejection drive waveform are selectively supplied to the analog switch 715.

[First Embodiment]

Next, a first embodiment is described with reference to FIG. 7. Note that in the description of the first embodiment, the "drive pulse" indicates a pulse having an element constituting the drive waveform, the "ejecting pulse" indicates a pulse applied to the pressure generator unit to eject droplets for printing, and the "non-ejecting pulse" indicates a pulse applied to the pressure generator unit but not to eject droplets for printing.

The first embodiment describes waveform examples for ejecting three sizes of droplets (large, medium small sized droplets). The drive waveform generator unit 701 generates a drive waveform (common drive waveform) Pv indicated by (a) in FIG. 7. The drive waveform Pv is obtained by generating the drive pulses P1 to P6 in time series within one printing cycle (one driving cycle).

Figure 8:
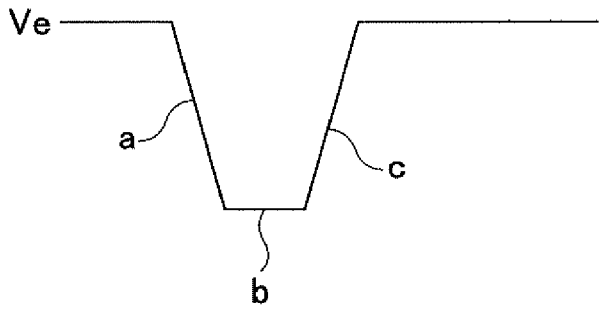
FIG. 8 is a diagram illustrating waveform components of a drive pulse in the image forming apparatus according to the first embodiment.

The waveform components for the corresponding drive pulses P1 to P6 are described as follows. As illustrated in FIG. 8, the drive pulses P1, P2, and P3 each include an expanding waveform component a for lowering the voltage to a predetermine hold potential from the reference potential Ve to expand the pressurizing liquid chamber 106, a holding waveform component b for holding the voltage at the lowered potential (hold potential), and a contracting waveform component c for raising the voltage from the hold potential to the reference potential Ve to contract the pressurizing liquid chamber 106. Note that the "hold potential" indicates a potential at which the drive pulse allows the pressurizing liquid chamber 106 to expand the most.

Figure 9:
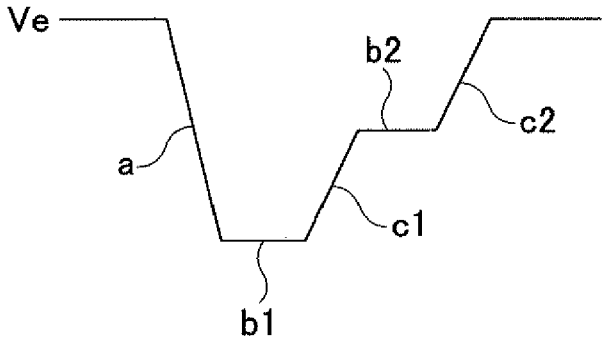
FIG. 9 is a diagram illustrating other waveform components of a drive pulse in the image forming apparatus according to the first embodiment.

As illustrated in FIG. 9, the drive pulse P4 includes an expanding waveform component a for lowering the voltage to a predetermine hold potential from the reference potential Ve to expand the pressurizing liquid chamber 106, a holding waveform component b1 for holding the voltage at the hold potential, a first (first-phase) contracting waveform component c1 for raising the voltage from the hold potential to a predetermined midpoint potential to contract the pressurizing liquid chamber 106, and a second (second-phase) contracting waveform component c2 for raising the voltage from the predetermined midpoint potential to the reference potential Ve to contract the pressurizing liquid chamber 106.

Figure 10:
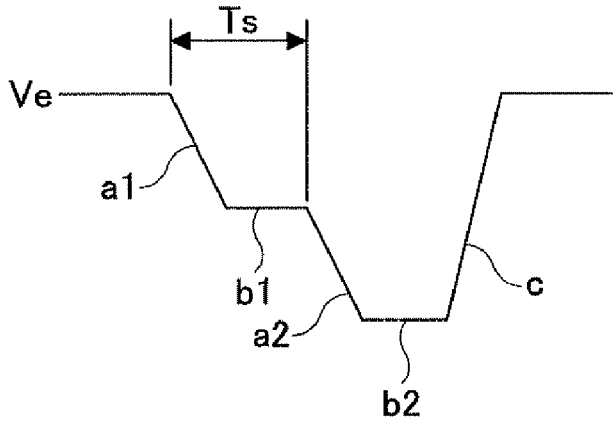
FIG. 10 is a diagram illustrating still other waveform components of a drive pulse in the image forming apparatus according to the first embodiment.

As illustrated in FIG. 10, the drive pulse P5 includes a first (first-phase) expanding waveform component al for lowering the voltage to a predetermined midpoint potential from the reference potential Ve to expand the pressurizing liquid chamber 106, a holding waveform component b1 for holding the voltage at the predetermined midpoint potential, a second (second-phase) expanding waveform component a2 for lowering the voltage from the predetermined midpoint potential to the hold potential to expand the pressurizing liquid chamber 106, a holding waveform component b2 for holding the voltage at the hold potential, and a contracting waveform component c for raising the voltage from the hold potential to the reference potential Ve to contract the pressurizing liquid chamber 106.

In the drive pulse having a waveform component for retracting a meniscus by expanding the pressurizing liquid chamber in two phases immediately before ejecting liquid droplets by contracting the pressurizing liquid chamber 106, when Ts represents a time interval between a starting point of a first-phase pressurizing liquid chamber expansion and a starting point of a second-phase pressurizing liquid chamber expansion, and Tc represents a Helmholtz resonance cycle, the drive pulse satisfies a relationship represented by $0.3\ Tc \leqq Ts \leqq 0.7\ Tc$. Accordingly, an ejecting pulse for ejecting a droplet without deflecting the droplet may be obtained. In this case, the second-phase pressurizing liquid chamber expansion is initiated when meniscus retraction is recovered to an ordinary position ($Tc=0.5$) by the first-phase pressurizing liquid chamber expansion. Accordingly, excessive meniscus retraction or bubble involution may be prevented.

Figure 11:
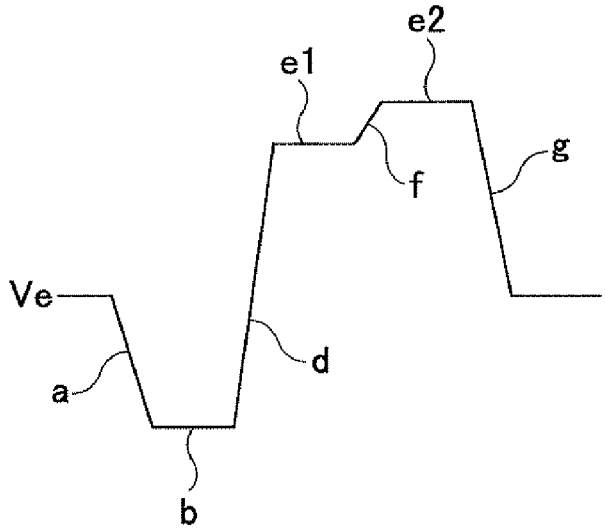
FIG. 11 is a diagram illustrating further other waveform components of a drive pulse in the image forming apparatus according to the first embodiment.

As illustrated in FIG. 11, the drive pulse P6 includes an expanding waveform component a for lowering the voltage to a predetermine hold potential from the reference potential Ve to expand the pressurizing liquid chamber 106, a holding waveform component b for holding the voltage at the hold potential, a contracting waveform component d for raising the voltage from the hold potential to the midpoint potential exceeding the reference potential Ve to contract the pressurizing liquid chamber 106, a holding waveform component e1 for holding the voltage at the raised potential by the contracting waveform component d, a contracting waveform component f for further raising the voltage from the raised potential held by the holding waveform component e1 to contract the pressurizing liquid chamber 106, a holding waveform component e2 for holding the voltage at the further raised potential by the contracting waveform component f, and a lowering waveform component g for lowering the voltage from the voltage from the potential held by the holding waveform component e2 to the reference potential Ve.

Figure 7:
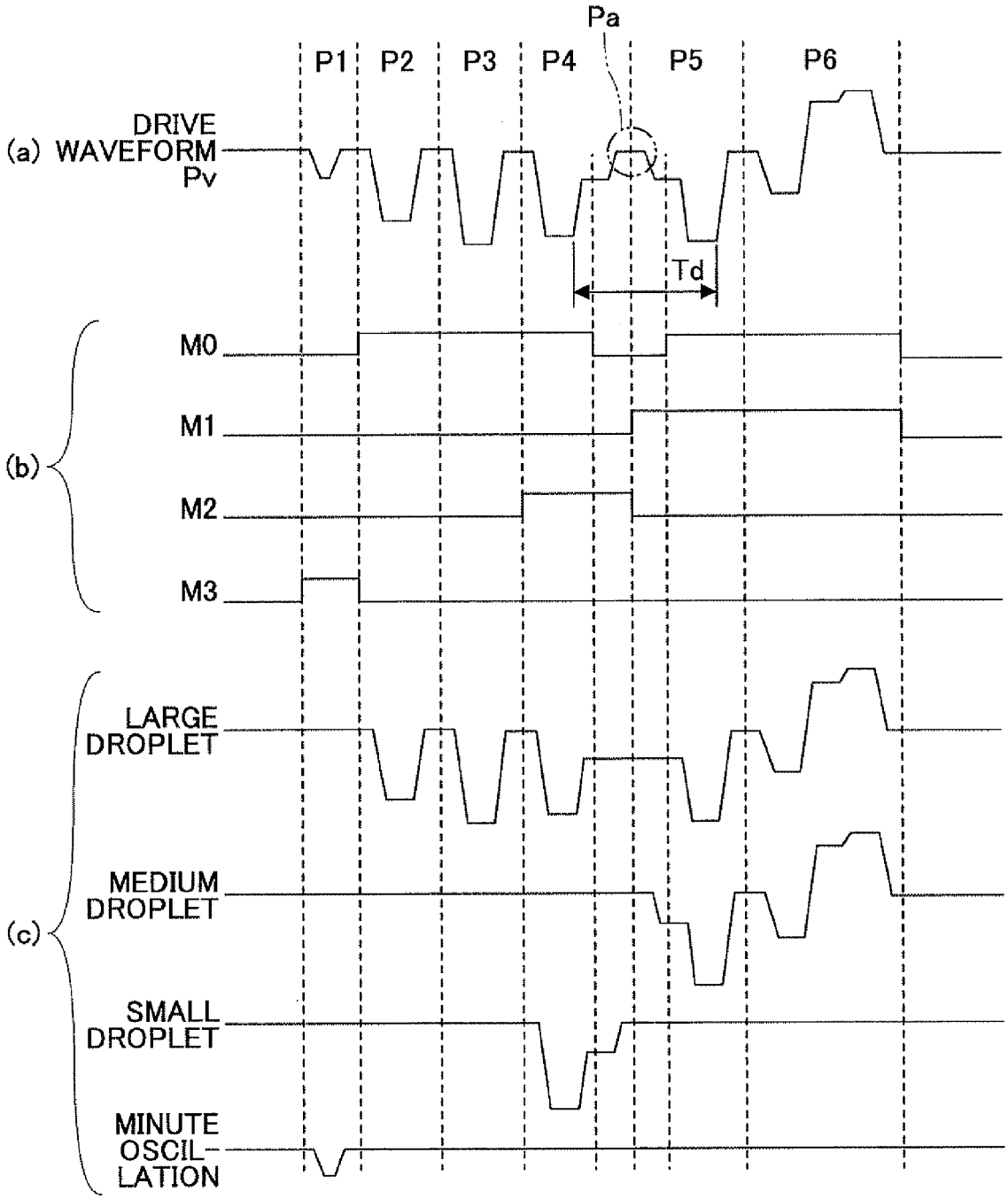
FIG. 7 is a diagram illustrating a drive waveform, droplet control signals, and droplet sizes in relation to drive pulses in the image forming apparatus according to a first embodiment.

The drive waveform generator unit 702 generates droplet control signals M0 through M3 indicated by (b) in FIG. 7. The droplet control signal M0 selects all the corresponding drive pulse waveform components (in this example, all the waveform components of P2, P3, and P6) and parts of the corresponding drive pulse waveform components (in this example, part of P4 and part of P5) to generate ejecting pulses for ejecting a large liquid droplet. Note that the large sized droplet is formed by ejecting plural droplets. The droplet control signal M1 selects all the corresponding drive pulse waveform components or parts of the corresponding drive pulse waveform components (in this example, all the waveform components of P5 and P6) to generate ejecting pulses for ejecting a medium liquid droplet. The droplet control signal M2 selects all the corresponding drive pulse waveform components or parts of the corresponding drive pulse waveform components (in this example, all the waveform components of P4) to generate ejecting pulses for ejecting a small liquid droplet. The droplet control signal M3 selects all the corresponding drive pulse waveform components or parts of the corresponding drive pulse waveform components (in this example, all the waveform components of P1) to generate non-ejecting pulses for minute oscillation.

That is, as indicted by (c) in FIG. 7, a small sized droplet is formed by selecting the drive pulse P4. Note that the ejecting pulses may also be generated by selecting the drive pulses P2 and P3 for ejecting the small sized droplet. The medium sized droplet is formed by selecting the continuous drive pulses P5 and P6. The large sized droplet is formed by selecting the continuous drive pulses P2 through P6.

In this process, when the medium sized droplet is ejected based on the drive pulse P5 of the continuous drive pulses P4 and P5, all the drive pulse waveform components of the drive pulse P5 are selected. By contrast, when the large sized droplet is ejected based on the continuous drive pulses P4 and P5, ejecting pulses are generated without selecting both a part of the drive pulse waveform components of the drive pulse P4 (second-phase contracting waveform component c2) and a part of the drive pulse waveform components of P5 (first-phase expanding waveform component a1), but based on the different parts (shapes) of the drive pulses P4 and P5. That is, the ejecting pulses based on the continuous drive pulses P4 and P5 have different shapes of the waveform components.

Note that if the pressure generator unit is the piezoelectric member, the voltage (hold potential) of the holding waveform component b2 of the drive pulse P4 is continuously applied to the piezoelectric member. As a result, the same voltage (hold potential of the holding waveform component b2 of the drive pulse P4) is held for the holding waveform component b1 of the drive pulse P5 until the application of the second (second-phase) expanding waveform component a2 is activated (excluding the potential change by the self-discharge of the piezoelectric member).

Further, when Td represents a time interval between a contraction starting point of the drive pulse P4 (i.e., a starting point of the first-phase contracting waveform component c1) for contracting the pressurizing liquid chamber 106 and a contraction starting point of the drive pulse P5 (i.e., a starting point of the contracting waveform component c) for contracting the pressurizing liquid chamber 106, and Tc represents a Helmholtz resonance cycle, the time interval Td is arranged to satisfy a relationship represented by $(N-1/4)\,Tc \leqq Td \leqq (N+1/4)\,Tc$ (N is a natural number). Accordingly, the meniscus at the contract start time of the drive pulse P5 is oscillated in an ejecting direction. As a result, the liquid droplet ejecting speed may be increased based on the drive pulse P5, which facilitates merging of the liquid droplets into a large liquid droplet while the liquid droplets are being ejected.

As described above, when the drive pulse P4 for forming a small sized droplet is used as the ejecting pulse for contracting the pressurizing liquid chamber 106 in two phases, a small liquid droplet (having a small amount of liquid) may be ejected while maintaining a high droplet ejecting speed.

Further, when the drive pulse P5 for forming a medium sized droplet is used as the ejecting pulse to expand the pressurizing liquid chamber 106 in two phases so that little ejecting droplet deflection is obtained, a medium liquid droplet may be formed by ejecting the liquid droplets onto a recording medium without deflecting the liquid droplets.

When forming a large sized droplet, a large amount of liquid is required with a short drive waveform length. Accordingly, it is desirable to continuously drive the drive pulses P4 and P5. However, if the ejecting pulses are formed based on the continuous drive pulses P4 and P5, a projection pulse Pa is formed between the continuous drive pulses P4 and P5. If the projection pulse Pa is present between the continuous drive pulses P4 and P5, meniscus oscillation having a phase opposite to that of the Helmholtz resonance cycle Tc is generated in two phases in the continuous drive pulses P4 and P5. Accordingly, the ejecting speed (ejecting energy) of a liquid droplet based on the drive pulse P5 is largely decreased, which makes it difficult to merge the ejected liquid droplets into a large liquid droplet. Further, the meniscus oscillation becomes unstable to lower the ejection reliability due to the projection pulse Pa having the opposite phase. Note that in this case, the drive pulses P4 and P5 correspond to "third" and "fourth" drive pulses.

Thus, when forming a large liquid droplet, pulse shapes of the drive pulses P4 and P5 are changed to prevent the projection pulse Pa from being applied along with the ejecting pulses generated using the drive pulses P4 and P5. Thus, a resonant drive of the drive pulses P4 and P5 may be secured. As a result, a high ejection efficiency and high ejection reliability may be obtained.

As described above, the ejecting pulses are formed by selecting the drive pulses in order to form liquid droplets of different sizes. If the ejecting pulse is formed by changing shapes of parts of the waveform components (i.e., changing pulse shapes) of the corresponding drive pulse to form the liquid droplet of the corresponding size, the entire length of the drive waveform in one printing cycle (or one driving cycle) may be decreased. Accordingly, the ejecting speed and the ejection reliability may be increased.

Specifically, if intervals between the plural drive pulses are each determined (arranged) to satisfy a relationship in which the contraction starting point of the pressurizing chamber 106 corresponds to an integral multiple of the Helmholtz resonance cycle Tc, the ejecting efficiency may be improved. In forming liquid droplets of plural sizes, it is preferable that the first ejecting pulse be used for retracting the meniscus in two phases in order to prevent the droplet deflection. However, if the drive waveform is formed (arranged) to satisfy this condition (first ejecting pulse is used for retracting the meniscus in two phases), a group of ejecting pulses for retracting the meniscus in two phases may be formed immediately after forming the ejecting pulse for extending the meniscus in two phases. In this case, even if the two drive pulses are arranged to satisfy the relationship in which the contraction starting point of the pressurizing chamber 106 corresponds to the integral multiple of the Helmholtz resonance cycle Tc, the projection pulse Pa having the phase opposite to that of the Helmholtz resonance cycle Tc may be formed between the two drive pulses. Accordingly, the ejection efficiency between the two pulses may be lowered. Further, the projection pulse Pa having the opposite phase destabilizes the amplitude of the meniscus, which may cause instability of the next ejecting pulse or inability to eject subsequent droplets, thereby reducing the ejection reliability.

In order to overcome drawbacks, when the ejecting pulses are formed based on two continuous drive pulses; that is, one for extending the meniscus in two phases and the other is for retracting the meniscus in two phases, the ejecting pulses are formed without using (selecting) both a part of the drive pulse for extending the meniscus in two phases and a part of the drive pulse for retracting the meniscus in two phases. In this manner, the projection pulse Pa having the opposite phase may not be formed between the two ejecting pulses. Accordingly, the meniscus resonance effect may be efficiently obtained. Further, instability of the meniscus amplitude may be prevented, thereby improving the ejection reliability.

As described above, the plural drive pulses capable of forming the drive waveform to form liquid droplets of different sizes include the third drive pulse having an ejecting waveform component for contracting the pressurizing liquid chamber in two phases immediately after retracting the meniscus by expanding the pressurizing liquid chamber, and the fourth drive pulse having a retracting waveform component for retracting the meniscus in two phases by expanding the pressurizing liquid chamber in at least two phases immediately after the third drive pulse is formed and immediately before contracting the pressurizing liquid chamber to eject droplets. When the third and fourth drive pulses are continuously driven within one printing cycle, ejecting pulses for ejecting a droplet are formed without selected parts of both the third drive pulse and the fourth drive pulse. That is, the ejecting pulses include an ejecting pulse for ejecting a droplet by contracting the pressurizing liquid chamber in one phase immediately after retracting the meniscus by expanding the pressurizing liquid chamber based on the third drive pulse, and an ejecting pulse for ejecting a droplet by contracting the pressurizing liquid chamber immediately after retracting the meniscus in one phase based on the fourth drive pulse. When the third and fourth drive pulses are not continuously driven within one printing cycle, the ejecting pulses are formed by selecting all the waveform components of the third and fourth drive pulses. As a result, the projection pulse Pa having the opposite phase is not formed between the two ejecting pulses, thereby efficiently obtaining the meniscus resonance effect. Further, instability of the meniscus amplitude maybe prevented, thereby improving the ejection reliability.

[Second Embodiment]

Next, a second embodiment is described with reference to FIG. 12. In the second embodiment, the drive waveform Pv includes five drive pulses P11 through P15 indicated by (a) in FIG. 12. In this example, similar to the drive pulse P5 in the first embodiment, the drive pulses P12 and P14 each include an expanding waveform component for expanding the pressurizing liquid chamber 106 in two phases. Similar to the drive pulse P4 in the first embodiment, the drive pulses P 13 includes a contracting waveform component for contracting the pressurizing liquid chamber 106 in two phases. The drive pulse P15 has the same waveform components as those of the drive pulse P6 in the first embodiment.

Figure 12:
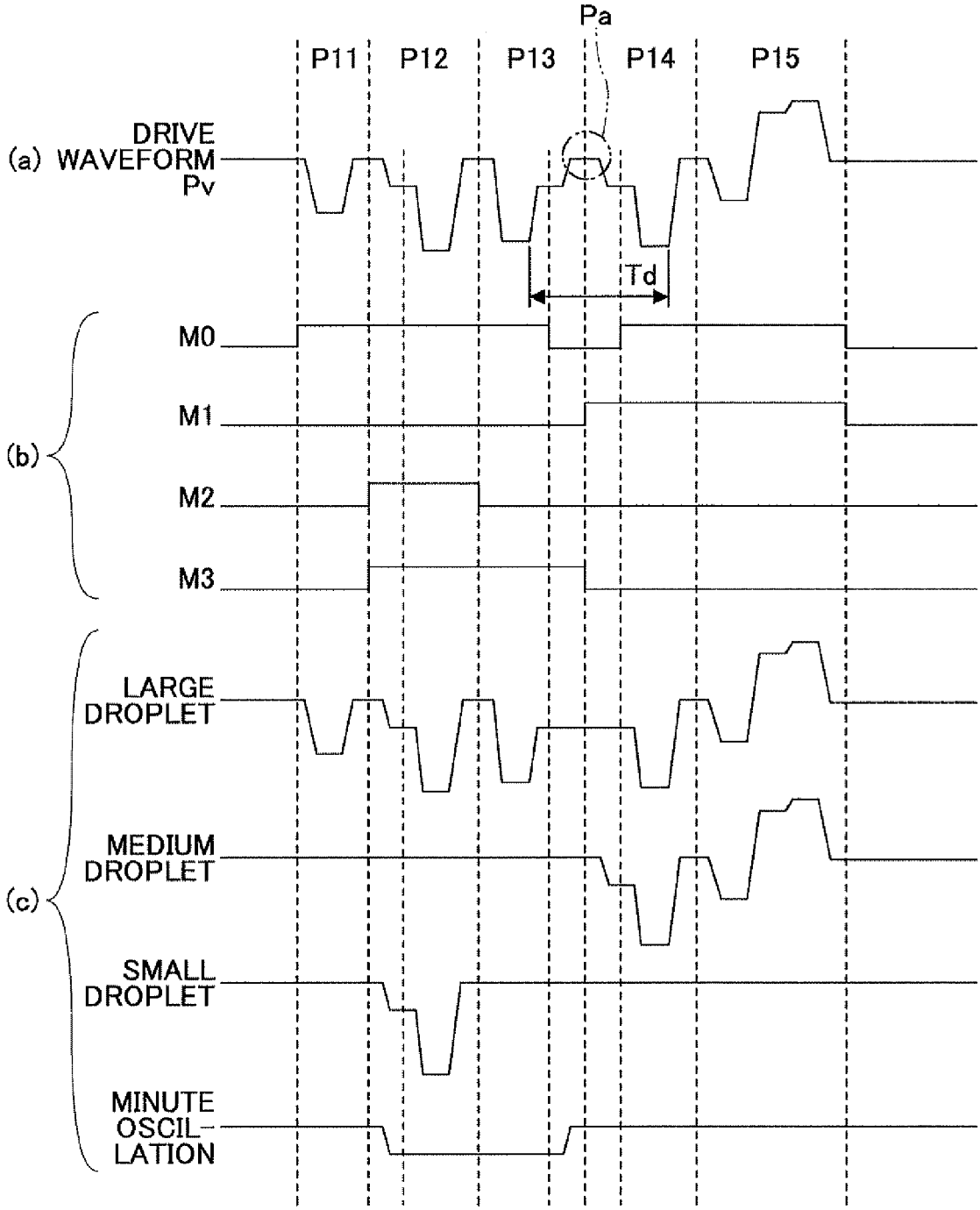
FIG. 12 is a diagram illustrating a drive waveform, droplet control signals, and droplet sizes in relation to drive pulses in the image forming apparatus according to a second embodiment.

Similar to the first embodiment, when the droplet control signals M0 through M3 indicated by (b) in FIG. 12 are applied, a small sized droplet is ejected based on the drive pulse P12, a medium sized droplet is ejected based on the drive pulses P14 and P15, and a large sized droplet is ejected based on the drive pulses P11 to P15.

When the drive pulse P13 and the drive pulse P14 are not continuously selected for ejecting the medium sized droplet, the ejecting pulse is formed by selecting all the waveform components of the drive pulse P14.

By contrast, when the continuous drive pulses P13 and P14 are selected for forming a large sized droplet, the ejecting pulses are formed without selecting both a part of the drive pulse P13 and a part of the drive pulse P14.

Similar to the first embodiment, when Td represents an interval between the drive pulse P13 and the drive pulse P14 (i.e., time interval Td between a starting point of the drive pulse P13 for contracting the pressurizing liquid chamber in one phase and a starting point of the drive pulse P14 for contracting the pressurizing liquid chamber) and Tc represents the Helmholtz resonance cycle Tc of the pressurizing liquid chamber 106, the interval Td is arranged to satisfy a relationship represented by $(N-1/4)\,Tc \leqq Td \leqq (N+1/4)\,Tc$ (N is a natural number).

Further, the minute drive (oscillation) pulse (i.e., non-ejecting pulse) is formed based on part of the drive pulse P12 and part of the drive pulse P13 for oscillating the meniscus without allowing the nozzle to eject a droplet. When the minute drive (oscillation) pulse is formed by selecting both a part of the drive pulse P12 and a part of the drive pulse P13, there is no need to form a designated minute drive pulse and the drive waveform length is thus reduced. As a result, liquid droplets are ejected at a high frequency, thereby increasing the printing speed. In this case, the drive pulses P12 and P13 correspond to "first" and "second" drive pulses.

Further, similar to the first embodiment, when the drive pulse P14 for expanding the pressurizing liquid chamber in two phases is selected for ejecting the first droplet, a medium sized droplet may be ejected without deflection.

Moreover, the minute drive pulse is formed based on part of the drive pulse P12 and part of the drive pulse P13 to decrease the length of the drive waveform, and the medium sized droplet is formed by selecting the drive pulse P14 for expanding the pressurizing chamber in two phases to prevent the droplet deflection. Similar to the first embodiment, when ejecting a large sized droplet, the ejecting pulse is formed without selecting the projection pulse Pa having the opposite phase (a phase of the meniscus generated based on the drive pulses P13 and P14 that has the same cycle as the Helmholtz resonance cycle Tc of the pressurizing liquid chamber 106) but formed by selecting all the waveform components of the corresponding drive pulse P13 and drive pulse P14. Note that the shape of the ejecting pulse is changed if the ejecting pulse is formed based on the pulse shapes of the drive pulses P13 and P14. In this manner, high ejection efficiency and high ejection reliability may be obtained.

When ejecting droplets of different sizes, the first ejecting pulse is used as the ejecting pulse for retracting the meniscus in two phases. Accordingly, the droplet deflection may be prevented.

That is, when non-uniform or inconsistent wettability around a nozzle is present due to abrasion or exfoliation of a water repellent film or ink fixed around the nozzle, the meniscus in the nozzle may become non-uniform when oscillating the meniscus. Accordingly, the ink droplets ejected from the nozzle may easily be deflected. Specifically, the meniscus may overflow around the nozzle immediately after ejecting a large or medium sized droplet, and the next droplet ejected is most likely to deflect. When the droplet deflection occurs, the image quality is degraded. Note that the basic ejecting pulse is formed by selecting the drive pulse for retracting the meniscus by expanding the pressurizing liquid chamber in one phase immediately before ejecting a droplet by contracting the pressurizing liquid chamber. However, when ejecting a liquid droplet with a non-uniform meniscus in the nozzle, the ejecting pulse formed based on the drive pulse for retracting the meniscus by expanding the pressurizing liquid chamber in two phases is preferable to the ejecting pulse formed based on the drive pulse for retracting the meniscus by expanding the pressurizing liquid chamber in one phase.

When ejecting droplets of different sizes, the first ejecting pulse in time series (in the order of ejecting droplets of different sizes) is used as the ejecting pulse for retracting the meniscus in two phases. In this manner, the nozzle deteriorated with time may be capable of ejecting a droplet without deflection. Thus, the degradation in the image quality may be lowered and the ejection reliability is improved.

In the second embodiment, the non-drive pulse is formed by selecting a first drive pulse having a drive waveform component for retracting the meniscus by expanding the pressurizing liquid chamber at least in two phases immediately before ejecting a droplet by contracting the pressurizing liquid chamber, and a second drive pulse having a drive waveform component for ejecting a droplet by contracting the pressurizing liquid chamber immediately after retracting the meniscus by expanding the pressurizing liquid chamber in two phases. When generating a non-ejecting pulse for driving the pressure generator unit without droplet ejection, the non-ejecting pulse is formed by selecting both a part of the first drive pulse and a part of the second drive pulse.

That is, the ejection reliability may be reduced due to the viscosity of the ink increased by drying in one or more nozzles that are less likely to eject ink droplets than the rest of the nozzles. In order to recover the reliability, it is preferable to constantly mix the ink having increased viscosity inside the nozzles that are less likely to eject ink droplets with the ink having low viscosity inside the frequently used nozzles by regularly oscillating the meniscus. The minute oscillation pulse is designed to oscillate the meniscus not to eject the droplets, and hence the minute drive (oscillation) pulse does not drive the ejecting pulses. In the related art technologies, the minute drive pulse designated for minutely oscillating the meniscus is provided. However, if the minute drive (oscillation) pulse is provided, the drive waveform length may be increased, thereby decreasing the drive frequencies to lower the printing speed.

By contrast, if the minute drive (oscillation) pulse for preventing the ink in the nozzle from drying by oscillating the meniscus without allowing the nozzle to eject droplets is formed based on part of the drive pulse, the designated minute drive pulse may not be needed. Accordingly, the drive waveform length may be shortened corresponding to the time used for the designated minute drive pulse, thereby increasing the drive frequencies and the printing speed.

[Third Embodiment]

Next, a third embodiment is described with reference to FIG. 13. In the third embodiment, the drive waveform Pv includes five drive pulses P21 through P25 indicated by (a) in FIG. 13. In this example, similar to the drive pulse P5 in the first embodiment, the drive pulses P21 and P24 each include an expanding waveform component for expanding the pressurizing liquid chamber 106 in two phases. Similar to the drive pulse P4 in the first embodiment, the drive pulses P 23 includes a contracting waveform component for contracting the pressurizing liquid chamber 106 in two phases. The drive pulse P25 has the same waveform components as those of the drive pulse P6 in the first embodiment.

Figure 13:
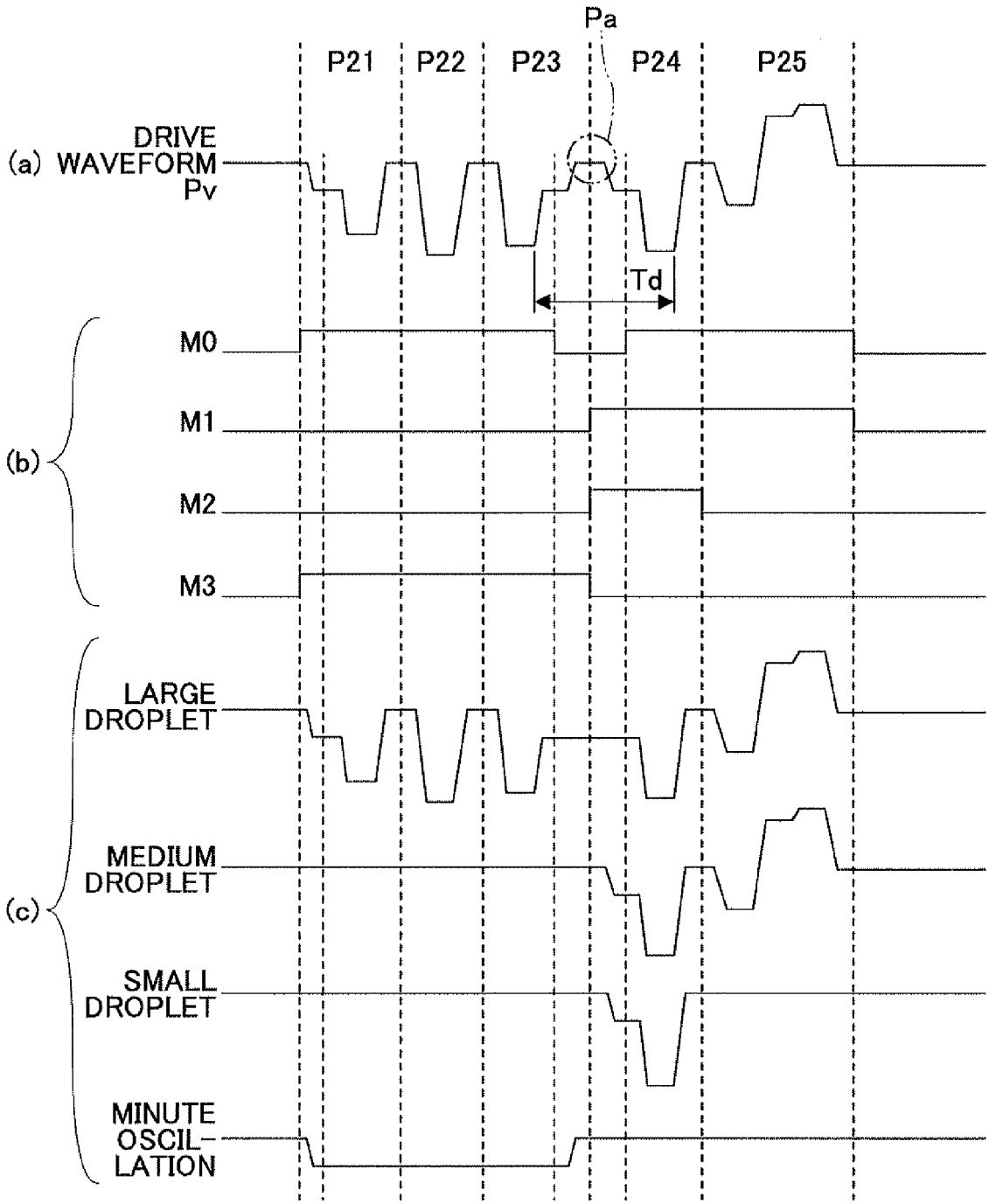
FIG. 13 is a diagram illustrating a drive waveform, droplet control signals, and droplet sizes in relation to drive pulses in the image forming apparatus according to a third embodiment.

Similar to the first embodiment, when the droplet control signals M0 through M3 indicated by (b) in FIG. 13 are applied, a small sized droplet is ejected based on the drive pulse P24, a medium sized droplet is ejected based on the drive pulses P24 and P25, and a large sized droplet is ejected based on the drive pulses P21 to P25.

In this process, all the waveform components of the drive pulse P24 are selected to form the ejecting pulse while ejecting the medium sized droplet without selecting the drive pulse P23 of the continuous drive pulses P23 and P24.

By contrast, when the continuous drive pulses P23 and P24 are selected to form a large sized droplet, the ejecting pulse is formed without selecting both a part of the drive pulse P23 and a part of the drive pulse P24. Similar to the first embodiment, when Td represents an interval between the drive pulse P23 and the drive pulse P24 (i.e., time interval Td between a starting point of the drive pulse P23 for contracting the pressurizing liquid chamber 106 in one phase and a starting point of the drive pulse P24 for contracting the pressurizing liquid chamber 106) and Tc represents the Helmholtz resonance cycle of the pressurizing liquid chamber 106, the interval Td is arranged to satisfy a relationship represented by $(N-1/4)\,Tc \leqq Td \leqq (N+1/4)\,Tc$ (N is a natural number).

Further, the minute drive (oscillation) pulse (i.e., non-ejecting pulse) is formed for oscillating the meniscus without allowing the nozzle to eject a droplet based on a part of the drive pulse P21 and a part of the drive pulse P23.

In this example, the drive pulse for ejecting the first droplet capable of forming all the sizes is formed by selecting the drive pulse for expanding the pressurizing liquid chamber in two phases. Accordingly, an effect of preventing the droplet deflection maybe obtained. That is, the ejecting droplet of the small size and the first ejecting droplet of the medium size are ejected based on the drive pulse P24, and the first ejecting droplet of the large size is ejected based on the drive pulse P21. Note that the drive pulses P21 and P24 each include an expanding waveform component for expanding the pressurizing liquid chamber 106 in two phases.

Further, the minute drive pulse (i.e., non-ejecting pulse) is formed based on part of the drive pulse P21 and part of the drive pulse P23 to oscillate the meniscus so as not to eject a droplet without having a designated minute drive pulse for oscillating the meniscus for shortening the drive waveform length.

Moreover, similar to the first and second embodiments, when ejecting a large sized droplet, apart of the drive pulse P23 and a part of the drive pulse P24 are not used (pulse shapes of the drive pulses P23 and P24 are changed) such that the projection pulse Pa is not formed between the continuous drive pulses P23 and P24. Accordingly, a high ejection efficiency and high ejection reliability may be obtained.

[Fourth Embodiment]

Next, a fourth embodiment is described with reference to FIG. 14. In the fourth embodiment, the drive waveform Pv includes five drive pulses P31 through P35 indicated by (a) in FIG. 14. In this example, similar to the drive pulse P5 in the first embodiment, the drive pulses P31, P32 and P34 each include an expanding waveform component for expanding the pressurizing liquid chamber 106 in two phases. Similar to the drive pulse P4 in the first embodiment, the drive pulses P 33 includes a contracting waveform component for contracting the pressurizing liquid chamber 106 in two phases. The drive pulse P35 has the same waveform components as those of the drive pulse P6 in the first embodiment.

Figure 14:
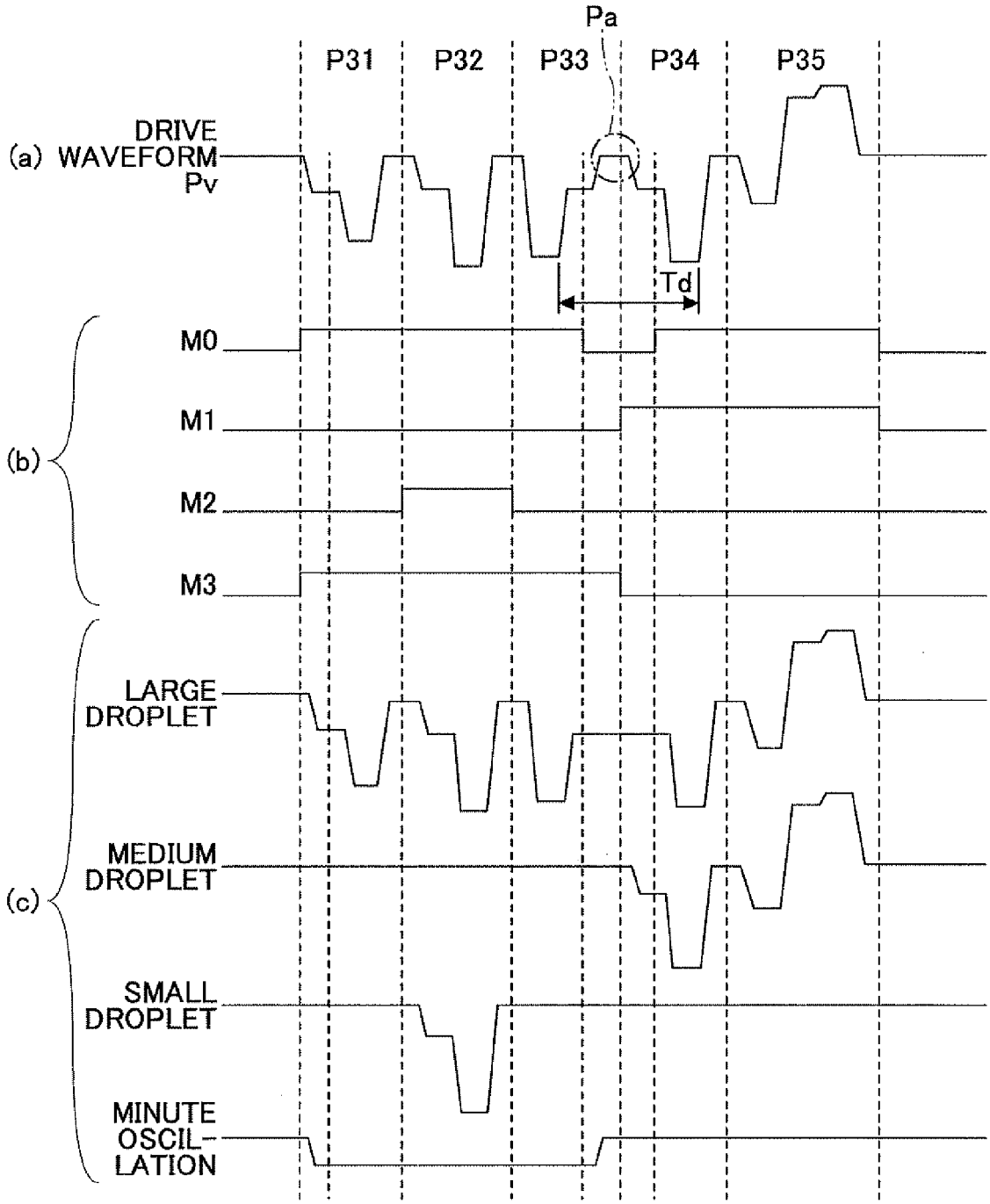
FIG. 14 is a diagram illustrating a drive waveform, droplet control signals, and droplet sizes in relation to drive pulses in the image forming apparatus according to a fourth embodiment.

Similar to the first embodiment, when the droplet control signals M0 through M3 indicated by (b) in FIG. 14 are applied, a small sized droplet is ejected based on the drive pulse P32, a medium sized droplet is ejected based on the drive pulses P34 and P35, and a large sized droplet is ejected based on the drive pulses P31 to P35.

In this process, all the drive pulse waveform components of the drive pulse P34 are selected to form the ejecting pulse while ejecting the medium sized droplet without selecting the drive pulse P33 of the continuous drive pulses P33 and P34.

By contrast, when ejecting a large sized droplet by selecting the continuous drive pulses P33 and P34, the ejecting pulse is formed by not selecting both a part of the drive waveform components of the drive pulse P33 and a part of the drive waveform components of the drive pulse P34. Similar to the first embodiment, when Td represents an interval between the drive pulse P33 and the drive pulse P34 (i.e., time interval Td between a starting point of the drive pulse P23 for contracting the pressurizing liquid chamber in one phase and a starting point of the drive pulse P34 for contracting the pressurizing liquid chamber)and Tc represents the Helmholtz resonance cycle of the pressurizing liquid chamber 106, the interval Td is arranged to satisfy a relationship represented by $(N-1/4)\,Tc \leqq Td \leqq (N+1/4)\,Tc$ (N is a natural number).

Further, the minute drive pulse (i.e., non-ejecting pulse) is formed for oscillating the meniscus without allowing the nozzle to eject a droplet based on a part of the drive pulse P31 and a part of the drive pulse P33.

Similar to the third embodiment, the drive pulse for ejecting the first droplet capable of forming all the sizes is formed by selecting the drive pulse for expanding the pressurizing liquid chamber in two phases. Accordingly, the droplet deflection may be prevented for droplets of all the sizes. That is, in the fourth embodiment, the ejecting droplet of the small size is ejected based on the drive pulse P32, the first ejecting droplet of the medium size is ejected based on the drive pulse P34, and the first ejecting droplet of the large size is ejected based on the drive pulse P31. Note that the drive pulses P31, P32 and P34 each include an expanding waveform component for expanding the pressurizing liquid chamber 106 in two phases.

Further, the minute drive pulse (i.e., non-ejecting pulse) is formed based on a part of the drive pulse P31 and a part of the drive pulse P33 to oscillate the meniscus so as not to eject a droplet without having a designated minute drive pulse for oscillating the meniscus, thereby shortening the drive waveform length.

Moreover, similar to the first to third embodiments, when ejecting a large sized droplet, both a part of the drive pulse P33 and a part of the drive pulse P34 are not used or selected (pulse shapes of the drive pulses P33 and P34 are changed) such that the projection pulse Pa is not formed between the continuous drive pulse P33 and P34. Accordingly, a high ejection efficiency and high ejection reliability may be obtained.

In the following, the shapes of the drive pulses in the first to the fourth embodiments are specified under corresponding conditions and described as fifth to eighth embodiments. In the following conditions, a displacement time (rising edge or falling edge) and a displacement stop time (holding time) for each voltage change point in each drive pulse are set to the time regions illustrated below for the Helmholtz resonance cycle Tc of the pressurizing liquid chamber of the head. Accordingly, the drive pulse capable of providing a high ejection efficiency and capable of reducing droplet deflection may be obtained.

[Fifth Embodiment]

Figure 15:
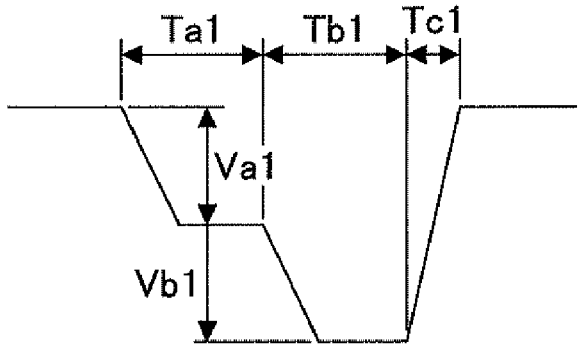
FIG. 15 is a diagram illustrating a drive waveform in relation to drive pulses in the image forming apparatus according to a fifth embodiment.

First, the fifth embodiment is described with reference to FIG. 15. The drive pulse for expanding the pressurizing liquid chamber 106 in two phases (also called a "two-phase meniscus retracting (pull) waveform") according to the first to fourth embodiments has a waveform illustrated in FIG. 15. As illustrated in FIG. 15, there are conditions (relationships) described below between a first expanding time (i.e., first meniscus retracting time) Ta1, a second expanding time (i.e., second meniscus retracting time) Tb1, a first contracting time (i.e., first meniscus extending time) Tc1, and the Helmholtz resonance cycle Tc.

$$(1/2-1/8)*Tc<Ta1<(1/2+1/8)*Tc \quad \text{condition 1-1}$$

$$(1/2-1/8)*Tc\leqq Tb1\leqq(1/2+1/8)*Tc \quad \text{condition 1-2}$$

$$1/10*Tc\leqq Tc1\leqq 1/3*Tc \quad \text{condition 1-3}$$

$$1/5\leqq Va1/Vb1\leqq 1/1 \quad \text{condition 1-4}$$

With the application of the condition 1-1, the fluctuation in the ejecting speed Vj due to the meniscus oscillation of the preceding droplet maybe reduced, which may little affect the following liquid droplet ejected based on the drive pulse illustrated in FIG. 15. For example, immediately after ejecting a large sized droplet, the meniscus formed in the nozzle may have a large cycle refill oscillation. However, if a retracting time of a two-phase retracting waveform (i.e., expanding time of two-phase expanding waveform) is applied as the condition 1-1, reduction in the ejecting (droplet) speed may be prevented and the droplet deflection in the position of the recording medium may be reduced.

Further, the deflected amount while ejecting may also be reduced. That is, immediately after ejecting the preceding droplet, the meniscus may easily overflow from the nozzle. As a result, the droplet deflection may easily occur if ejected based on the subsequent drive pulse. However, if the two-phase meniscus retracting pull waveform that satisfies the above condition 1-1 is applied, the meniscus is first retracted inside the nozzle, and the ejecting operation is initiated when the displacement speed of the meniscus is approximately 0. Accordingly, the droplet deflection may rarely occur when driving the nozzle with an overflowing meniscus. Further, the deflected amount of the ejected droplet may also be reduced.

Further, when the above conditions 1-2 and 1-3 are applied, high ejection efficiency (high ejecting speed Vj or large ejecting amount Mj of the droplets based on displacement) may be obtained.

Moreover, when the first meniscus retracting voltage Va1 and the second meniscus retracting voltage Vd1 are set within a range of the condition 1-4, the above described effects (lowering the amount of the ejecting (droplet) and lowering the amount of droplet deflection) may be obtained. Further, such effects maybe improved as the value Va1/Vb1 (i.e., the meniscus retracting voltage Va is increased) is increased.

[Sixth Embodiment]

Figure 16:
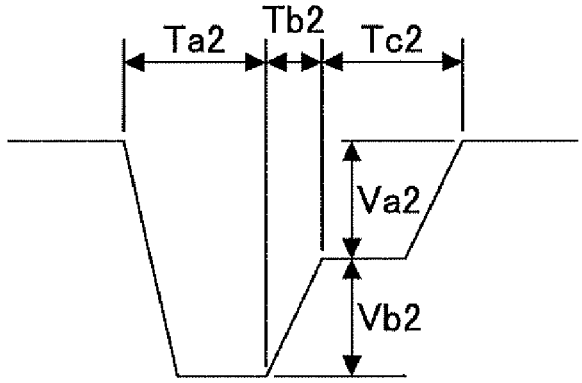
FIG. 16 is a diagram illustrating a drive waveform in relation to drive pulses in the image forming apparatus according to a sixth embodiment.

Next, the sixth embodiment is described with reference to FIG. 16. The drive pulse for contracting the pressurizing liquid chamber 106 in two phases (also called a "two-phase extending push waveform") according to the first to fourth embodiments has a waveform illustrated in FIG. 16. As illustrated in FIG. 16, there are conditions (relationships) described below between a first expanding time (i.e., first meniscus retracting time) Ta2, a first contracting time (i.e., first meniscus extending time) Tb2, a second contracting time (i.e., second meniscus extending time) Tc2, and the Helmholtz resonance cycle Tc.

$$(1/2-1/8)*Tc\leqq Ta2\leqq(1/2+1/8)*Tc \quad \text{condition 2-1}$$

$$(1/2-1/8)*Tc\leqq Tb2\leqq(1/2+1/8)*Tc \quad \text{condition 2-2}$$

$$1/10*Tc\leqq Tc2\leqq 1/3*Tc \quad \text{condition 2-3}$$

$$1/5\leqq Va2/Vb2\leqq 1/1 \quad \text{condition 2-4}$$

If the drive pulse illustrated in FIG. 16 satisfies the conditions 2-1 and 2-3, high ejection efficiency may be obtained. Further, if the drive pulse illustrated in FIG. 16 satisfies the condition 2-2, an adverse effect on the next drive pulse driven immediately after the currently applied drive pulse may be reduced. That is, as illustrated in FIG. 16, meniscus oscillation having an oscillation cycle Tc may be generated in the meniscus formed in the nozzle simultaneously when the droplets are ejected by the first meniscus retracting displacement (first expanding waveform component) and the first meniscus extending displacement (first contracting waveform component). However, since the second meniscus extending displacement (second contracting waveform component) that satisfies the condition 2-2 generates the displacement to cause the meniscus oscillation having a phase opposite to the oscillation generated by the first meniscus retracting displacement, it is possible to obtain an effect of reducing (damping) the large meniscus oscillation generated by the first meniscus retracting displacement and the first meniscus extending displacement.

Accordingly, the amplitude of meniscus oscillation generated by the drive pulse illustrated in FIG. 16 may be reduced (damped), and an adverse effect on the ejecting characteristic of the next ejecting of the liquid droplet may not occur, thereby preventing the droplet deflection in the next ejecting of the liquid droplet.

[Seventh Embodiment]

Figure 17:
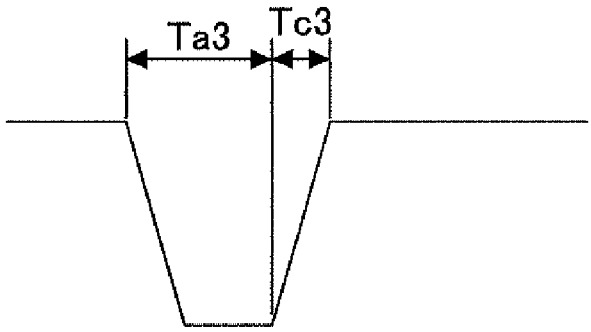
FIG. 17 is a diagram illustrating a drive waveform in relation to drive pulses in the image forming apparatus according to a seventh embodiment.

Next, the seventh embodiment is described with reference to FIG. 17. The simple pull drive pulse for expanding or contracting the pressurizing liquid chamber 106 in one phase according to the first to fourth embodiments has a waveform illustrated in FIG. 17. As illustrated in FIG. 17, there are conditions (relationships) described below between an expanding time (i.e., meniscus retracting and holding time) Ta3, a contracting time (i.e., meniscus extending time) Tc3 and the Helmholtz resonance cycle Tc.

$(1/2-1/8)*Tc \leqq Ta3 \leqq (1/2+1/8)*Tc$ condition 3-1

$1/10*Tc \leqq Tc3 \leqq 1/3*Tc$ condition 3-2

If the drive pulse illustrated in FIG. 17 satisfies the conditions 3-1 and 3-2, high ejection efficiency may be obtained.

[Eighth Embodiment]

Next, the eighth embodiment is described with reference to FIGS. 18 to 20. The ejecting pulse formed by selecting a part of the drive waveform components of the drive pulse based on the ejection amount of the liquid droplets according to the first to fourth embodiments has a waveform illustrated in FIGS. 18 to 20. Note that for each drive pulse, there are conditions (relationships) described below between a first meniscus retracting time Ta4 or Ta5, a first meniscus extending time Tc4 or Tc5, a drive pulse interval Td6 between the drive pulses, and the Helmholtz resonance cycle Tc.

$(1/2-1/8)*Tc \leqq Ta4 \leqq (1/2+1/8)*Tc$ condition 4-1

$(1/2-1/8)*Tc \leqq Ta5 \leqq (1/2+1/8)*Tc$ condition 4-2

$1/10*Tc \leqq Tc4 \leqq 1/3*Tc$ condition 4-3

$1/10*Tc \leqq Tc5 \leqq 1/3*Tc$ condition 4-4

$(Z-1/4)*Tc \leqq Td6 \leqq (Z+1/4)*Tc$ (Z: natural number) condition 4-5

Figure 18:
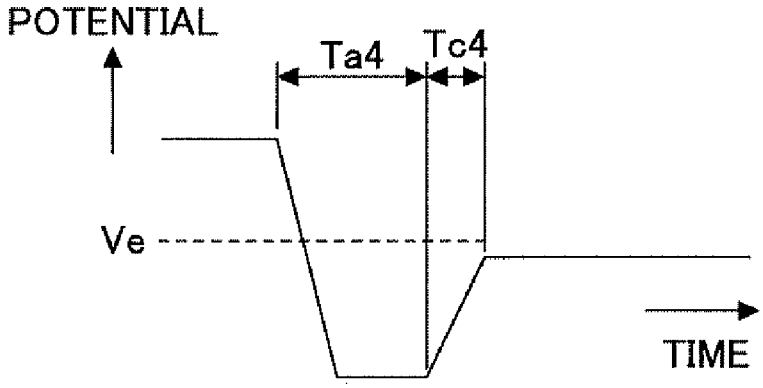
FIG. 18 is a diagram illustrating a drive waveform in relation to drive pulses in the image forming apparatus according to an eighth embodiment.
Figure 19:
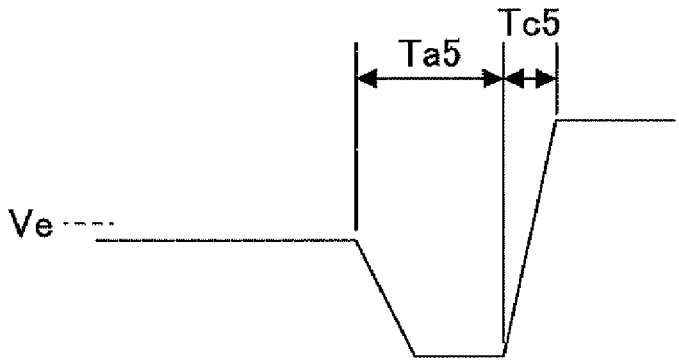
FIG. 19 is another diagram illustrating the drive waveform in relation to the drive pulses in the image forming apparatus according to the eighth embodiment.
Figure 20:
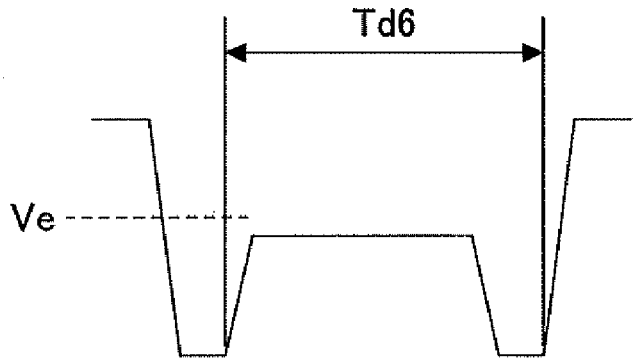
FIG. 20 is still another diagram illustrating the drive waveform in relation to the drive pulses in the image forming apparatus according to the eighth embodiment.

If each of the drive pulses illustrated in FIGS. 18 to 20 satisfies the conditions 4-1 and 4-4, high ejection efficiency may be obtained based on the drive pulses.

If the condition 4-5 is satisfied, higher ejection efficiency may be obtained based the resonance of the two drive pulses.

For example, the drive pulse for ejecting the first droplet of the medium size according to the first to fourth embodiments has the same waveform components as those of the drive pulse used for ejecting the fourth droplet of the large size. In the medium sized liquid droplet configuration (driving of the continuous drive pulses at the end of the drive waveform) according to the eighth embodiment, it may be difficult to merge the third droplet with the fourth and fifth droplets while they are being ejected unless the ejecting speed of the large sized fourth droplet is faster than that of the medium sized droplet. In order for the droplets to merge to reliably form a large sized droplet, it is preferable to satisfy the condition 4-5 under any of the drive conditions. If the condition 4-5 is satisfied in the first to fourth embodiments, the drive pulse for ejecting the fourth droplet may have the resonance drive effect of the third droplet. As a result, the ejecting speed of ejecting the fourth droplet may be increased, thereby reliably merging the droplets to form a large liquid droplet.

Figure 21:
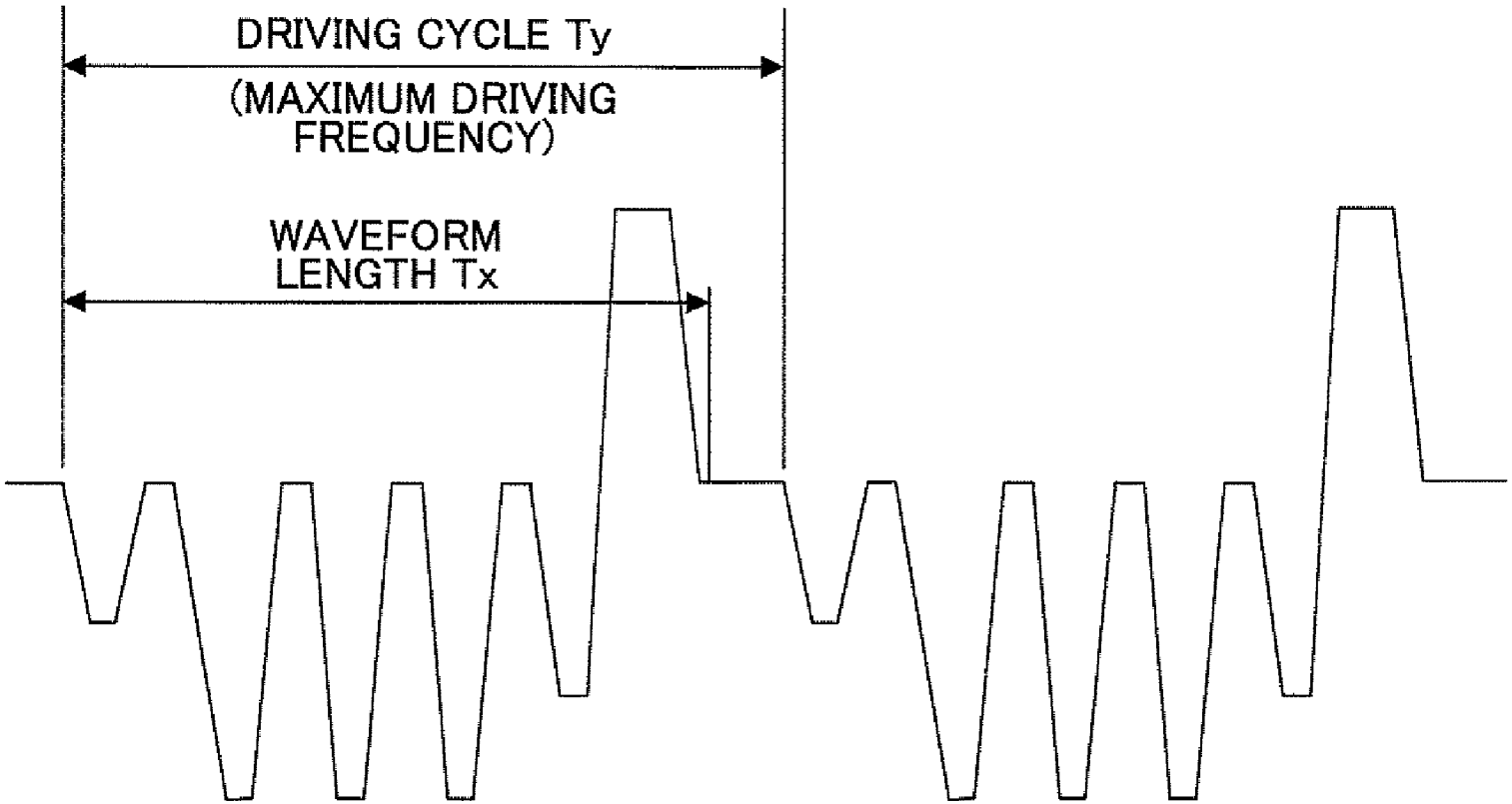
FIG. 21 is a diagram illustrating a relationship between a driving cycle and a corresponding drive waveform length.

Next, as described above, a relationship between the minute drive pulse (non-ejecting pulse) formed based on a part of the drive pulse having an effect on the ejection of droplet and the ejecting pulse formed based on the drive pulse according to the eighth embodiment is described with reference to FIGS. 21 and 22. As illustrated in FIG. 21, the waveform length Tx of the drive waveform needs to be shorter than the drive cycle (one printing cycle) Ty. In this process, if the wavelength Tx of the drive waveform is sufficiently shorter than the drive cycle Ty to satisfy a target specification, it is possible to provide the designated minute drive pulse. However, if the waveform length Tx of the drive waveform is not sufficiently shorter than the drive cycle Ty to carry out high frequency driving, the waveform length designated for the minute drive pulse may be reduced.

Further, in the method for merging plural droplets based on the plural drive pulses while ejecting the plural droplets, the intervals between the drive pulses (drive pulse arrangements) may be widened or narrowed in order to merge the ejecting droplets to form a medium sized or large sized droplet or in order to adjust the ejecting speed of the medium sized or large sized droplet on the recording medium (ejected position). The ejecting speed may be adjusted by controlling the drive time such as a resonant drive of 1.0 Tc or 2.0 Tc, or a non-resonant drive of 1.5 Tc.

Figure 22:
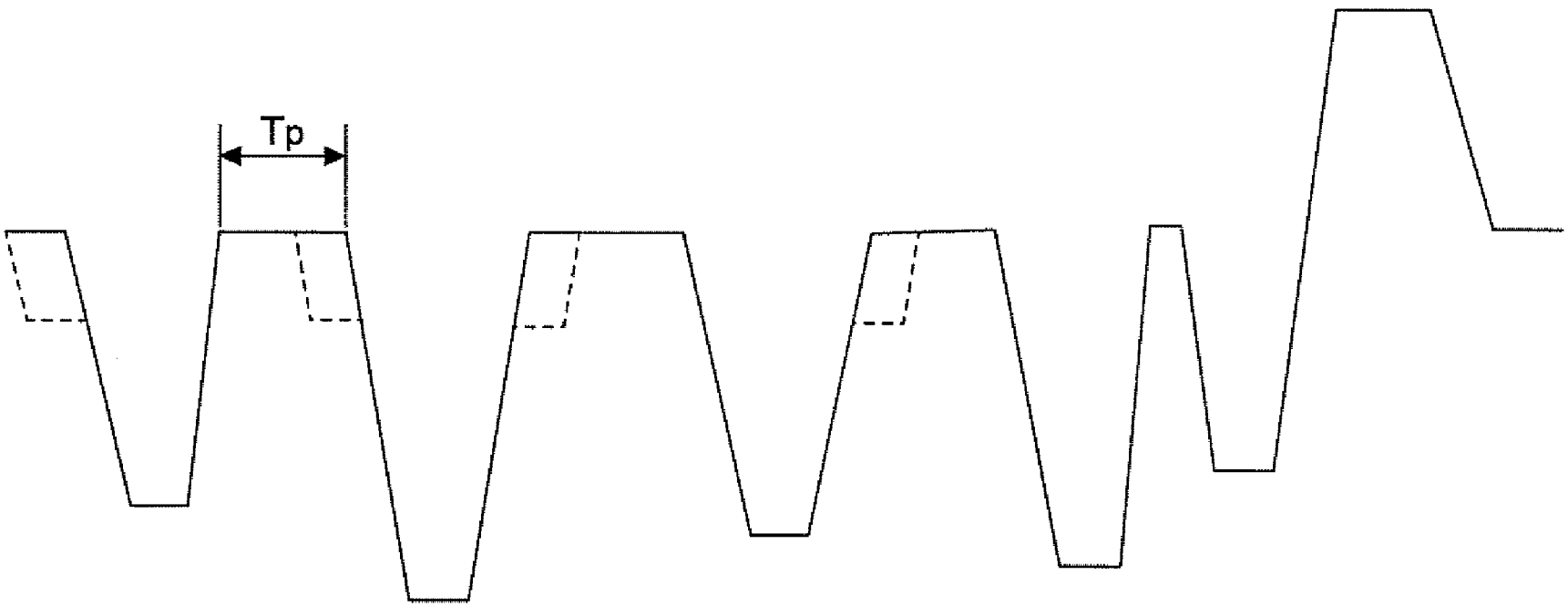
FIG. 22 is a diagram illustrating a relationship between an interval between the drive pulses and a corresponding drive waveform length.

As illustrated in FIG. 22, in order to adjust the ejecting speed, some drive pulse intervals Tp need to be wide regardless of having the drive pulse designated for the non-ejecting pulse. Accordingly, the non-ejecting pulse (minute drive pulse) is formed by efficiently utilizing the wide drive pulse interval Tp to shorten the waveform length, thereby carrying out a high frequency drive.

That is, it is preferable that the large sized, medium sized, and small sized droplets be ejected at the same positions on the recording medium. Note that it is preferable that any of the large sized medium sized, and small sized droplets be ejected at the center of the target dot (pixel). For example, when the second drive pulse is driven for ejecting a small sized droplet, the ejecting speed of the second droplet is driven based on the second drive pulse alone. When all the drive pulses are selected for ejecting a large sized droplet, all the droplets driven by the selected drive pulses are merged and ejected on the recording medium at the same speed as that of the small sized droplet ejection. That is, when the second droplet is driven by the second drive pulse alone, the second droplet is ejected at a target (desired) speed. However, if the first and second droplets are ejected at the target speed so that the first and second droplets are merged (i.e., the target speed is achieved by ejecting the first and second droplets), the droplet ejected subsequent to the first droplet and the second droplet is not merged with a merged droplet of the first droplet and the second droplet. Accordingly, it is preferable that the second droplet be ejected at a lower speed based on the first drive pulse. That is, the first and second droplets are driven at a non-resonant interval of 1.5 Tc or more.

Thus, the designated minute drive pulse need not be set by providing the non-resonant interval in the drive pulse intervals.

As described above, the drive intervals between the ejecting pulses (drive pulses) are arranged such that a relationship is satisfied in which the contraction starting point of the pressurizing chamber 106 corresponds to the integral multiple of the Helmholtz resonance cycle Tc. With this configuration, the ejecting efficiency may be improved. In a group of ejecting pulses to form the minute drive pulse formed of a part of the drive pulse for retracting the meniscus in two phases and a part of the drive pulse for extending the meniscus in two phases, if the drive pulse for retracting the meniscus in two phases is used as the first drive pulse capable of forming droplets of different sizes, a group of ejecting pulses to drive the drive pulse for retracting the meniscus in two phases maybe formed immediately after the formation of the drive pulse for extending the meniscus in two phases.

In this case, even if the two drive pulses are arranged to satisfy the relationship in which the contraction starting point of the pressurizing chamber 106 corresponds to the integral multiple of the Helmholtz resonance cycle Tc, the projection pulse Pa having the phase opposite to that of the Helmholtz resonance cycle Tc is formed between the two drive pulses. Accordingly, the ejection efficiency between the two drive pulses may be lowered. Further, the projection pulse Pa having the opposite phase destabilizes the amplitude of the meniscus, which may cause instability of the next ejecting pulse or inability to eject subsequent droplets, thereby reducing the ejection reliability.

Accordingly, when the drive pulse for extending the meniscus in two phases and the drive pulse for retracting the meniscus in two phases are continuously driven, the projection pulse having the opposite phase formed between the two drive pulses is not driven by not selecting both a part of the drive pulse for extending the meniscus in two phases and a part of the drive pulse for retracting the meniscus in two phases, thereby efficiently obtaining the meniscus resonance effect between the ejecting pulses. Further, instability of the meniscus amplitude may be prevented, thereby improving the ejection reliability.

Note that the image forming apparatus according to the embodiments is not limited to the image forming apparatus configured to have a printer function alone, but may include multiple functions including a printer function, a facsimile function, and a copier function.

According to the embodiments, the ejecting pulses are formed by selecting the drive pulses to form liquid droplets of different sizes. The ejecting pulse is formed by changing shapes of parts of the waveform components of the corresponding drive pulse in order to form the liquid droplet of the corresponding size. Accordingly, the entire length of the drive waveform in one printing cycle (or one driving cycle) may be decreased, thereby increasing the ejecting speed and the ejection reliability.

Embodiments of the present invention have been described heretofore for the purpose of illustration. The present invention is not limited to these embodiments, but various variations and modifications may be made without departing from the scope of the present invention. The present invention should not be interpreted as being limited to the embodiments that are described in the specification and illustrated in the drawings.

The present application is based on Japanese Priority Application No. 2009-212904 filed on Sep. 15, 2009, with the Japanese Patent Office, the entire contents of which are hereby incorporated by reference.

What is claimed is:

1. An image forming apparatus comprising:

a recording head having nozzles configured to eject liquid droplets, a liquid chamber in communication with the nozzles, and a pressure generator unit configured to generate pressure inside the liquid chamber to cause the nozzles to eject the liquid droplets; and a head drive control unit configured to generate a drive waveform having plural drive pulses arranged in time series, each of the drive pulses being formed by a designated arrangement of waveform components, to form at least one ejecting pulse for ejecting the liquid droplets by selecting one or more of the plural drive pulses of the drive waveform based on a corresponding one of liquid droplet sizes, and supply the at least one ejecting pulse based on the corresponding one of the liquid droplet sizes to the pressure generator unit, wherein, when the at least one ejecting pulse for ejecting the liquid droplets is formed by selecting a plurality of the plural drive pulses to form the corresponding one of the liquid droplet sizes, an arrangement of the waveform components of the selected plurality of drive pulses differs from the designated arrangement of the waveform components for each of the drive pulses.

2. The image forming apparatus as claimed in claim 1, wherein, when liquid droplets of different sizes formed, a first one of the drive pulses supplied to the pressure generator unit in time series includes a waveform component configured to retract a meniscus by expanding the liquid chamber at least in two phases immediately before ejecting a liquid droplet by contracting the liquid chamber.

3. The image forming apparatus as claimed in claim 1, wherein the plural drive pulses selected based on the corresponding one of the liquid droplet sizes include a first drive pulse having a waveform component configured to retract a meniscus by expanding the liquid chamber at least in two phases immediately before ejecting a liquid droplet by contracting the liquid chamber, and a second drive pulse output immediately after the first drive pulse and having a waveform component configured to eject the liquid droplet by contracting the liquid chamber in two phases immediately after retracting the meniscus by expanding the liquid chamber, and wherein a non-ejecting pulse configured to drive the pressure generator unit without allowing the nozzle to eject the liquid droplets is formed based on a part of the first drive pulse and a part of the second drive pulse.

4. The image forming apparatus as claimed in claim 1, wherein the plural drive pulses selected based on the corresponding one of the liquid droplet sizes include a third drive pulse having a waveform component configured to eject a liquid droplet by contracting the liquid chamber in two phases immediately after retracting a meniscus by expanding the liquid chamber, and a fourth drive pulse output immediately after the third drive pulse and having a waveform component configured to retract the meniscus by expanding the liquid chamber at least in two phases immediately before ejecting the liquid droplet by contracting the liquid chamber, wherein, when the third and fourth drive pulses are continuously driven within a printing cycle, the at least one ejecting pulse for ejecting the liquid droplets is formed by partially changing a shape of the third drive pulse for contracting the liquid chamber in one phase immediately after retracting the meniscus and a shape of the fourth drive pulse for contracting the liquid chamber immediately after retracting the meniscus by expanding the liquid chamber in one phase, and wherein, when the third and fourth drive pulses are not continuously driven within the printing cycle, a non-ejecting pulse is formed by selecting the corresponding waveform components of the third drive pulse and the fourth drive pulse.

5. The image forming apparatus as claimed in claim 4, wherein a time interval between a contraction starting point of the third drive pulse for contracting the liquid chamber and a contraction starting point of the fourth drive pulse for contracting the liquid chamber corresponds to an integral multiple of a Helmholtz resonance cycle.

6. The image forming apparatus as claimed in claim 5, wherein, when Td represents a time interval between the contraction starting point of the third drive pulse for contracting the liquid chamber and the contraction starting point of the fourth drive pulse for contracting the liquid chamber, and Tc represents a Helmholtz resonance cycle, the time interval Td is arranged to satisfy a relationship represented by $(N-1/4)\,Tc \leqq Td \leqq (N+1/4)\,Tc$ (N is a natural number).

7. The image forming apparatus as claimed in claim 1, wherein an ejecting pulse formed by selecting one of the plural drive pulses to form one of the liquid droplets of the corresponding one of the liquid droplet sizes is configured to retract a meniscus by expanding the liquid chamber in two phases immediately before ejecting the one of the liquid droplets by contracting the liquid chamber.

8. An image forming apparatus comprising:

a recording head having nozzles configured to eject liquid droplets, a liquid chamber in communication with the nozzles and pressure generator unit configured to generate pressure inside the liquid chamber to cause he nozzles to eject the liquid droplets; and a head drive control unit configured to generate a drive waveform having plural drive pulses arranged in time series, each of the drive pulses having waveform components, to form at least one ejecting pulse for ejecting the liquid droplets by selecting one or more of the plural drive pulses of the drive waveform based on a corresponding one of liquid droplet sizes, and supply the at least one ejecting pulse based on the corresponding one of the liquid droplet sizes to the pressure generator unit, wherein, when the at least one ejecting pulse for ejecting the liquid droplets is formed by selecting the one or more of the plural drive pulses, shapes of the waveform components of the selected plural drive pulses are partially changed based on the corresponding one of the liquid droplet sizes, wherein the drive waveform includes a drive pulse having a waveform component configured to retract a meniscus by expanding the liquid chamber in two phases having a first phase and a second phase immediately before ejecting a liquid droplet by contracting the liquid chamber, and wherein when Ts represents a time interval between an expanding starting point of the first phase of expanding the liquid chamber and an expanding starting point of the second phase of expanding the liquid chamber, and Tc represents a Helmholtz resonance cycle, the drive pulse is configured to set the time interval Ts to satisfy a relationship represented by $0.3\ Tc \leqq Ts \leqq 0.7\ Tc$.

* * * * *